US006302411B1

(12) United States Patent
Huffman et al.

(10) Patent No.: US 6,302,411 B1
(45) **Date of Patent: *Oct. 16, 2001**

(54) ROTATABLE SNOWBOARD BOOT BINDING

(75) Inventors: William A. Huffman, 3100 Hass Dr., Aptos, CA (US) 95003; Duncan S. Wade, Aptos, CA (US); Mark D. Brinkerhoff, San Jose, CA (US)

(73) Assignee: William A. Huffman, Los Gatos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/177,667

(22) Filed: Oct. 22, 1998

Related U.S. Application Data

(63) Continuation-in-part of application No. 09/097,019, filed on Jun. 12, 1998.

(51) Int. Cl.[7] ..... A63C 9/081
(52) U.S. Cl. ..... 280/14.24; 280/618
(58) Field of Search ..... 280/14.2, 617, 280/618, 625, 633, 634, 636, 607, 629, 14.22, 14.24

(56) References Cited

U.S. PATENT DOCUMENTS

| | | | | |
|---|---|---|---|---|
| 4,185,851 | * | 1/1980 | Salomon | 280/613 |
| 4,219,217 | * | 8/1980 | Gertsch | 280/629 |
| 4,896,895 | * | 1/1990 | Bettosini | 280/607 |
| 5,125,173 | | 6/1992 | Nagano et al. | 36/131 |
| 5,354,088 | | 10/1994 | Vetter et al. | 280/618 |
| 5,356,170 | | 10/1994 | Carpenter et al. | 280/618 |
| 5,499,837 | | 3/1996 | Hale et al. | 280/607 |
| 5,505,477 | | 4/1996 | Turner et al. | 280/613 |
| 5,520,405 | | 5/1996 | Bourke | 280/613 |
| 5,520,406 | | 5/1996 | Anderson et al. | 280/624 |
| 5,538,272 | * | 7/1996 | Peart | 280/602 |
| 5,553,883 | | 9/1996 | Erb | 280/607 |
| 5,556,123 | * | 9/1996 | Fournier | 280/607 |
| 5,577,755 | | 11/1996 | Metzger et al. | 280/607 |
| 5,586,779 | | 12/1996 | Dawes et al. | 280/14.2 |
| 5,664,797 | * | 9/1997 | Haughlin | 280/615 |
| 5,713,594 | * | 2/1998 | Jenni | 280/624 |
| 5,762,358 | | 6/1998 | Hale . | |
| 5,765,853 | * | 6/1998 | Erb | 280/607 |
| 5,803,481 | * | 9/1998 | Eaton et al. | 280/633 |
| 5,868,416 | * | 2/1999 | Fardie | 280/607 |
| 5,890,729 | * | 4/1999 | Bayer et al. | 280/618 |
| 5,897,128 | * | 4/1999 | McKenzie et al. | 280/607 |
| 5,909,894 | * | 6/1999 | Meader et al. | 280/623 |
| 5,915,721 | * | 6/1999 | Laughlin et al. | 280/617 |
| 5,941,552 | * | 8/1999 | Beran | 280/607 |
| 5,947,488 | * | 9/1999 | Gorza et al. | 280/14.2 |
| 5,975,554 | * | 11/1999 | Linton | 280/607 |
| 5,984,325 | * | 9/1999 | Acuna | 280/14.2 |
| 6,102,430 | * | 8/2000 | Reynolds | 280/618 |

FOREIGN PATENT DOCUMENTS 9749464 12/1997 (WO) .

OTHER PUBLICATIONS

PCT/US99/13299 Search Report mailed Sep. 7, 1999.

* cited by examiner

*Primary Examiner*—J. J. Swann
*Assistant Examiner*—David R. Dunn
(74) *Attorney, Agent, or Firm*—Blakely, Sokoloff, Taylor & Zafman

(57) ABSTRACT

A boot binding that is easily and quickly rotatable between different positions is disclosed. In one embodiment of the invention, a boot binding comprises a rotatable boot attachment member and an intermediate locking arrangement that holds the boot attachment member in an intermediate position. A force applied to the boot attachment member releases the intermediate locking arrangement such that the boot attachment member can be moved from its intermediate position to a different position.

37 Claims, 20 Drawing Sheets

ROTATABLE SNOWBOARD BOOT BINDING

This is a continuation-in-part of application Ser. No. 09/097,019, entitled Rotatable Snowboard Boot Binding, filed Jun. 12, 1998.

BACKGROUND OF THE INVENTION

1. Field of the Invention

The present invention relates generally to boot bindings, and more specifically to boot bindings for snowboards.

2. Background Information

Snowboarding requires the user to stand with both feet on the snowboard. Bindings on the snowboard secure the user's boots to the snowboard so that the user can adequately maneuver the snowboard. When riding the snowboard, the user's boots are bound such that they both point primarily toward one side of the snowboard. Unfortunately, when the user is on a flat area such as the path to a ski lift, it is difficult to create any forward movement because of the facts that both of the user's boots are bound to the snowboard and poles are not used in snowboarding, unlike skiing. Thus, the user must release the back boot from its binding and push forward in the same way a skateboarder uses a free foot to achieve forward movement. The problem with this situation is that the user's front boot is still bound to the snowboard at an awkward angle. That is, the longitudinal axis of the user's front boot is substantially non-parallel to the longitudinal axis of the snowboard. Thus, on one hand, the user is trying to push the snowboard in a forward direction with the back boot, but on the other hand, the user's front boot is pointing away from the forward direction.

Furthermore, when the user is sitting on a ski lift, the front boot is still bound to the snowboard while the back boot is free, causing one of the user's legs to twist at an uncomfortable angle as it dangles in the air. If two users are sitting next to each other on the ski lift, and they use opposite boots as their front boot, the twisting of their legs due to their respective bindings can cause their snowboards to collide with each other. This is not only irritating, but also potentially dangerous. Getting off a ski lift is also potentially troublesome because the angle at which the user's front boot is bound to the snowboard can make it difficult for the user to position the snowboard perpendicularly to the ski lift chair. If the snowboard is not positioned perpendicularly to the ski lift chair as the snowboard hits the ground, the user could veer off to one side and run into the person who had been sharing the ski lift.

The above mentioned problems affect all snowboard users, but beginning snowboard users are especially affected by such problems because they are unaccustomed to having their leg twisted at an awkward angle. When this awkwardness is coupled with the beginning snowboard user's overall inexperience with maneuvering and controlling a snowboard, the beginning snowboard user can be especially at risk to suffer an injury.

A user may ride a snowboard in a right-foot-forward position or in a left-foot-forward position. A right-foot-forward position is typically referred to as a "goofy foot" position. Since many users do not own their own snow boards, there is a market to provide rental snowboards for these users. Since the height, size, and foot orientation of a user will vary widely between users, it would be advantageous to have a boot binding that is easily adjustable to accommodate a wide variety of users.

Step-in type snowboard boot bindings are growing in popularity. The step-in bindings operate similarly to convention snow ski bindings. One problem with the step-in snowboard bindings is that the user's boot tends to shake or rattle within the binding during use.

Thus, what is needed is a boot binding that is easily and quickly rotatable to and from different positions, thereby allowing the user to select a comfortable, safe and useful angle for the user's boot and leg. Moreover, what is needed is a boot binding or apparatus that will stabilize the user's boot within the boot binding and/or absorb shock to the user's boot.

SUMMARY OF THE INVENTION

Therefore, it is an object of the present invention to provide a boot binding that is easily and quickly rotatable between different positions.

It is also an object of the present invention to provide a boot binding that is easily and quickly rotatable between a right-foot-forward position and a left-foot-forward position.

It is also an object of the present invention to provide a boot binding that has a thin profile relative to the thickness of the snowboard such that the user's center of gravity is not substantially raised.

It is also an object of the present invention to provide a boot binding wherein the stance position of the binding is easily and quickly adjustable.

It is also an object of the present invention to provide a boot binding that is shock absorbent.

It is a further object of the present invention to provide a boot binding that does not scratch the underlying snowboard when the boot binding is rotated or otherwise moved relative to the snowboard.

A snowboard boot binding in accordance with the present invention includes:

- a boot attachment member having a first opening; and
- a locking plate supported within said first opening of said boot attachment member, said boot attachment member slideable with said locking plate, said locking plate attachable to a snowboard.

A snowboard boot binding in accordance with another embodiment of the present invention includes:

- a boot attachment member having a first opening;
- a locking plate or locking ring supported within the first opening of the boot attachment member, the locking plate having a first slot and a second slot symmetrically located on the locking plate, the first slot defining a right-foot-forward radial riding position, the second slot defining a left-foot-forward radial riding position, the boot attachment member rotatably slideable between the first and second slots; and
- a stationary plate for mounting the boot attachment member to a snowboard, the stationary plate engaging the locking plate.

In accordance with another embodiment of the present invention, a boot binding is provided that includes:

- a boot attachment member having a first opening;
- a locking plate supported within the first opening of the boot attachment member, the boot attachment member slideable with the locking plate; and
- a stationary plate for mounting the boot attachment member to a snowboard, the stationary plate engaging the locking plate, the locking plate transversely moveable relative to the stationary plate.

In one embodiment of the present invention, a boot binding comprises a rotatable boot attachment member and an intermediate locking arrangement that holds the boot attachment member in an intermediate position. The intermediate locking arrangement can be released upon the application of a first force to the boot attachment member such that the boot attachment member can be moved from its intermediate position.

In another embodiment of the present invention, a boot binding comprises a rotatable boot attachment member, an initial locking arrangement and an intermediate locking arrangement. The initial locking arrangement holds the boot attachment member in an initial position, and the intermediate locking arrangement holds the boot attachment member in an intermediate position. The boot attachment member is rotatable from its intermediate position back to its initial position upon the application of a swivel force to the boot attachment member.

In still another embodiment of the present invention, a boot binding comprises a boot attachment member that has a number of pads disposed on a bottom surface of the boot attachment member such that the pads engage the snowboard to which the boot attachment member is attached. The pads have a surface hardness less than that of the snowboard, which protects the snowboard against scratching when the boot attachment member is moved relative to the snowboard.

In another embodiment of the present invention, a boot binding shock absorber is provided.

Additional features and benefits of the present invention will become apparent from the detailed description, figures and claims set forth below.

BRIEF DESCRIPTION OF THE DRAWINGS

Various embodiments of the present invention will be described in detail with reference to the following drawings in which like reference numerals refer to like elements. The present invention is illustrated by way of example and not limitation in the accompanying figures.

DETAILED DESCRIPTION

A snowboard boot binding is described. In the following description, specific details are set forth, in order to provide a thorough understanding of the invention. However, it will be obvious to one of ordinary skill in the art that the invention can be practiced without these specific details. In other instances, well-known processing steps, methods, materials, etc. have not been described in particular detail in order to avoid unnecessarily obscuring the invention. The invention will be described with specific reference to snowboards, but it is appreciated that the invention is not limited to any one field of use.

The invention provides a boot binding having a rotatable boot attachment member that is moveable from a first radial position to a second radial position by the application of a swivel force created by the rotation of a user's foot, and hence, the user's boot. The boot attachment member is configured to hold the boot worn on the user's foot. The boot attachment member is held in the first radial position by a first locking arrangement, which is releasable upon the application of the swivel force applied by the user. The boot attachment member is held securely in the second radial position by a second locking arrangement. The first radial position can be the user's non-ride position, in which the user's boot is at a more comfortable angle for pushing the underlying snowboard forward on unsloped areas or for sitting on a ski lift. The second radial position can be the user's ride position, in which the user's boot is at a conventional angle for riding the snowboard down a slope. The invention allows a user who was initially in a ride position but then switched intermediately to a non-ride position, to switch back to the ride position without using his or her hands.

Figure 1A:
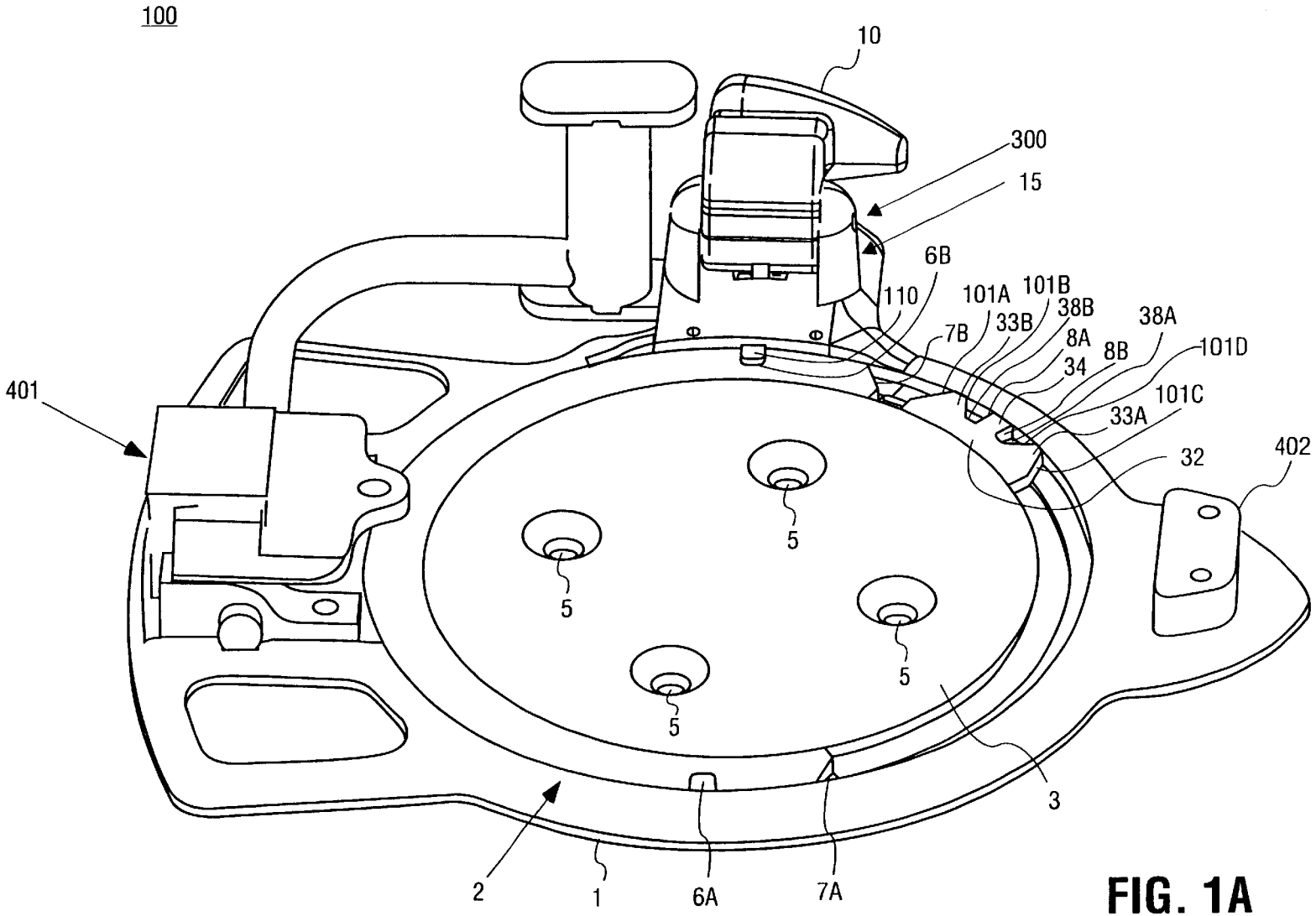
FIG. 1A shows an assembled boot binding in accordance with the teachings of the present invention.
Figure 1B:
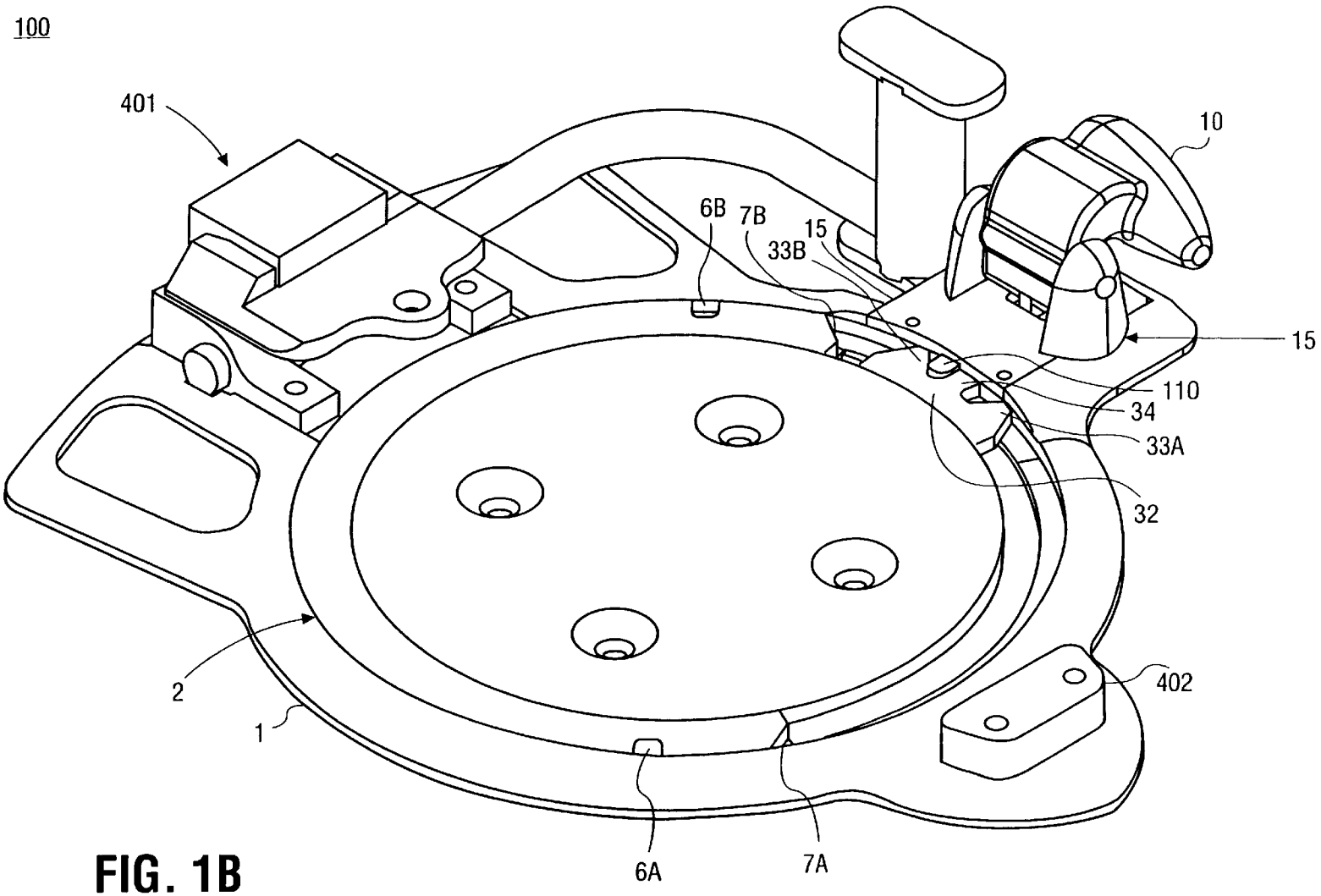
FIG. 1B shows a top view of an assembled boot binding with an alternative locking arrangement in accordance with the teachings of the present invention.
Figure 1C:
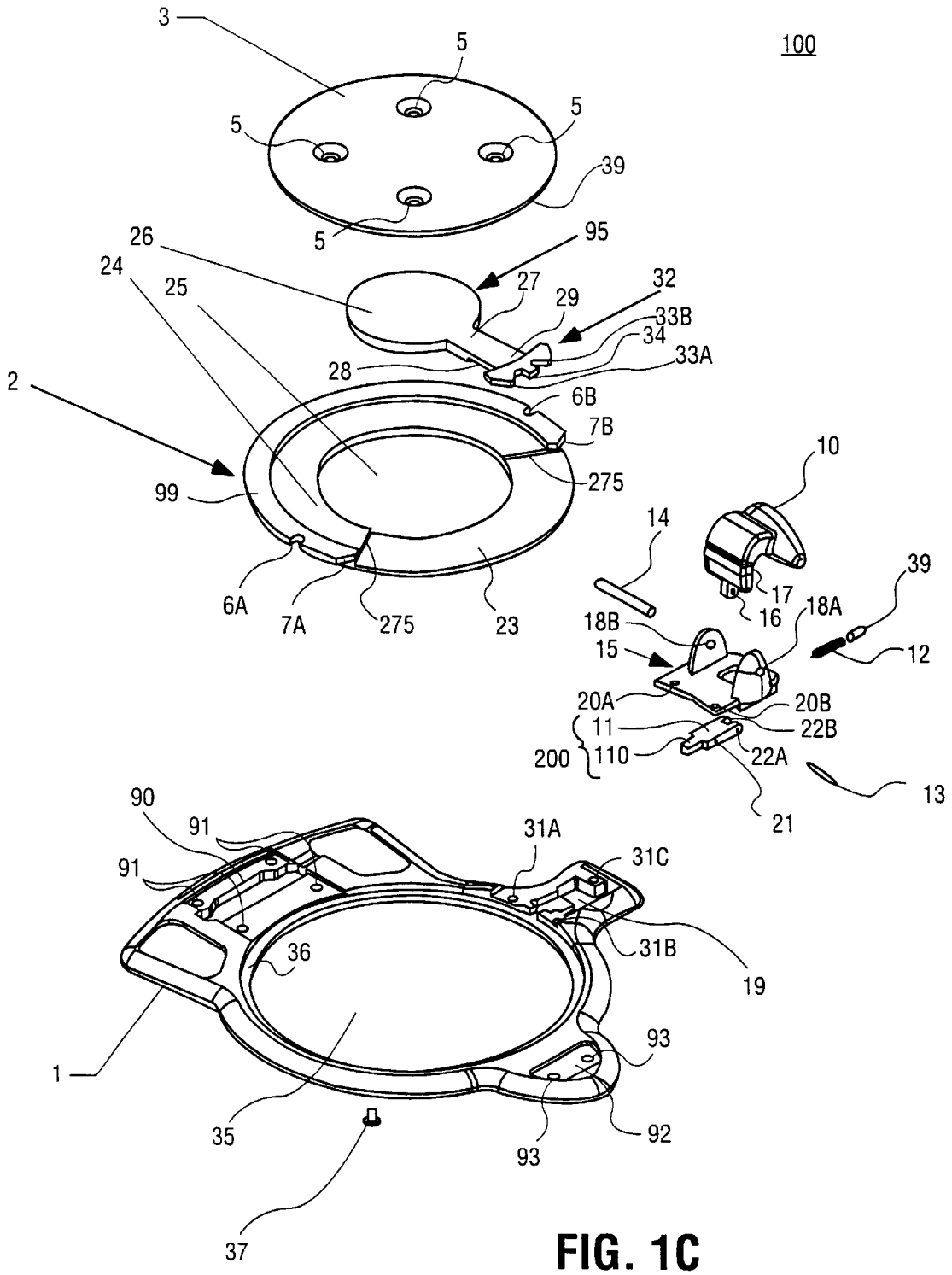
FIG. 1C shows an unassembled, expanded view of a boot binding in accordance with the teachings of the present invention.

FIGS. 1A, 1B and 1C show a boot binding assembly 100 in accordance with one embodiment of the invention. Assembly 100 includes a boot attachment member 1 that is rotatable around a locking ring 2, which resides within an opening 35 of boot attachment member 1. Boot attachment member 1 is shown having a heel clip 401 and a toe clip 402. However, it is to be understood that the invention is not limited to boot attachment members having such features. For example, boot attachment member 1 can be of the side clip type, center clip type, boot shell type, or any other suitable attachment mechanism. A securing plate 3 is engageable with locking ring 2. Securing plate 3 has threaded bolt holes 5 which accept bolts (not shown) that extend through bolt holes 5 into matching bolt holes in a snowboard (not shown), thereby securing the boot binding to the snowboard. A stopping member 32 extends from a cam 95 located between locking ring 2 and securing plate 3. Stopping member 32 has two double-angled portion 33*a* and 33*b* that are separated by a stopping portion 34. In one embodiment, stopping member 32 is symmetric. Locking ring 2 has slots 6*a* and 6*b* for accepting a moveable tab 110 of a locking mechanism 300. Locking mechanism 300 includes a release arm 10 and a spring 12 that is positioned within a housing 15 by a plug 39. Tab 110 and a main body 11 define a locking member 200. Release arm 10 is coupled to housing 15 which shields main body 11 and spring 12. It is appreciated that main body 11 is not required. It is further appreciated that locking mechanism 300 can be located at any convenient location around the periphery of boot attachment member 1.

Boot attachment member 1 is locked in an initial position when an initial locking arrangement, comprising tab 110 mating with either slot 6*a* or 6*b*, is in effect. Tab 110 is forced into a locked position by spring 12 as described in more detail below with respect to FIGS. 5A and 5B. Spring 12 continuously biases main body 11, and hence tab 110, in an inward direction toward locking ring 2. In one embodiment, the spring tension is adjustable which permits the force required to retract tab 110 to be varied according to a user's weight and/or strength. In another embodiment, a wire segment that is inserted into a through hole 21 of main body 11 with its ends secured to boot attachment member 1 is used instead of spring 12. In yet another embodiment, an elastomer member provides the biasing force. Release arm 10 is coupled to main body 11 to allow an opposing force to be applied to main body 11 such that tab 110 can be moved in an outward direction away from locking ring 2. The initial locking arrangement is released by a user pulling upward on release arm 10 to cause tab 110 to be withdrawn from either slot 6*a* or 6*b*. It should be noted that the invention is not limited to a tab-slot locking arrangement.

Figure 7:
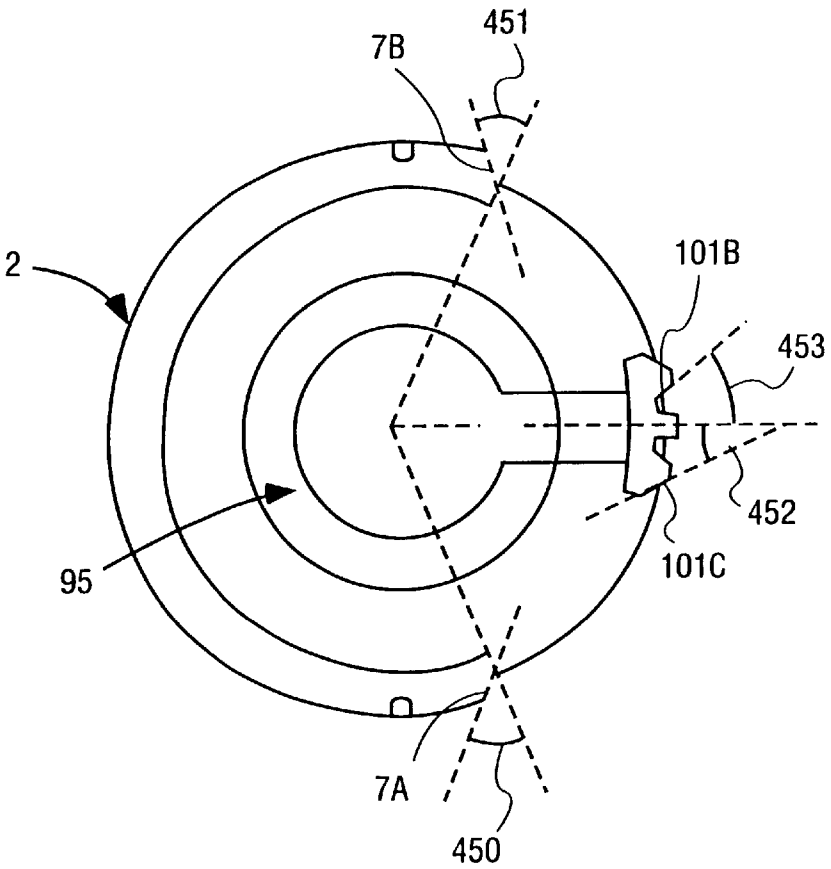
FIG. 7 shows several exemplary angles of positioning assembly components in accordance with the teachings of the present invention.

Once the initial locking arrangement is released, the user is able to rotate boot attachment member 1 by applying a swivel force to boot attachment member 1. This is typically accomplished by the user rotating a boot attached to boot attachment member 1. It should be noted that the boot binding shown in FIGS. 1A and 1B is configured for users who use their right boot as their front boot. The binding may be configured for users who use their left boot as their front boot. Once the user has rotated boot attachment member 1 enough so that tab 110 is beyond slot 6*b*, the user can release arm 10 and continue to swivel boot attachment member 1 until tab 110 engages with stopping member 32 as shown in FIG. 1B. Double-angled portions 33*a* and 33*b* of stopping member 32 are angled with an outer slope 101*c* and an inner slope 101*d* and an outer slope 101*a* and an inner slope 101*b*, respectively, such that tab 110 can slide into a space 38*a* or 38*b* between double-angled portion 33*a* and 33*b* and stopping portion 34 when boot attachment member 1 is swiveled toward stopping member 32. The angle 452 (see FIG. 7) of outer slope 101*c*, as well as outer slope 101*a*, is normally in the range of 20–30 degrees. Outer slope 101*a* is measured in the same manner as outer slope 101*c*. The angle 453 (see FIG. 7) of inner slope 101*b*, as well as inner slope 101*d*, is normally in the range of 40–50 degrees. Inner slope 101*d* is measured in the same manner as inner slope 101*b*. In lieu of the user having to pull release arm 10 to overcome the force of spring 12, the user can now rely on the swivel force of the boot to overcome the force of spring 12 when tab 110 comes into contact with either outer slopes 101*a*, 101*c* or inner slopes 101*b*, 101*d*. The walls 8*a*, 8*b* of stopping portion 34 act to prevent further rotation of boot attachment member 1 by blocking the path of tab 110.

When tab 110 has reached stopping portion 34, boot attachment member 1 is in an intermediate position as shown in FIG. 1B. An intermediate locking arrangement or locking assembly comprises tab 110 engaging with spaces 38*a* or 38*b* of stopping member 32. Because of inner slope 101*b*, the user can use the attached boot to swivel boot attachment member 1 in an opposite direction (toward slot 6*b*) without pulling on release arm 10. The swivel force of the boot is enough to overcome the force of spring 12 and retract tab 110 whether the user is swiveling boot attachment member 1 to engage or disengage tab 110 and stopping member 32. It should be noted that the angles of outer slopes 101*a*, 101*c* and inner slopes 101*b*, 101*d* can be chosen to vary the swivel force required to engage and disengage tab 110 and stopping member 32. By having two double-angled portions 33*a* and 33*b*, stopping member 32 can accommodate any user regardless of which boot is used as the front boot.

As boot attachment member 1 is swiveled toward slot 6*b*, tab 110 comes into contact with a single-angled portion 7*b* of locking ring 2. Single-angled portion 7*b* is angled such that the swivel force applied to boot attachment member 1 is sufficient to overcome the force of biasing means or spring 12 and retract tab 110 as tab 110 comes into contact with single-angled portion 7*b*. The angles 450 and 451 (se FIG. 7) of single-angled portions 7*a* and 7*b*, respectively, are typically in the range of 40–50 degrees. Once boot attachment member 1 is swiveled to slot 6*b*, tab 110 slides into slot 6*b* where tab 110 is locked, placing boot attachment member 1 back in its initial position. Thus, boot attachment member 1 can be rotated from an intermediate position back to an initial position by applying a swivel force to boot attachment member 1 via an attached boot. It should be noted that slot 6*a* and single-angled portion 7*a* are present to accommodate users who use the opposite foot, and therefore can rotate boot attachment member 1 around the opposite half of locking ring 2.

Figure 6B:
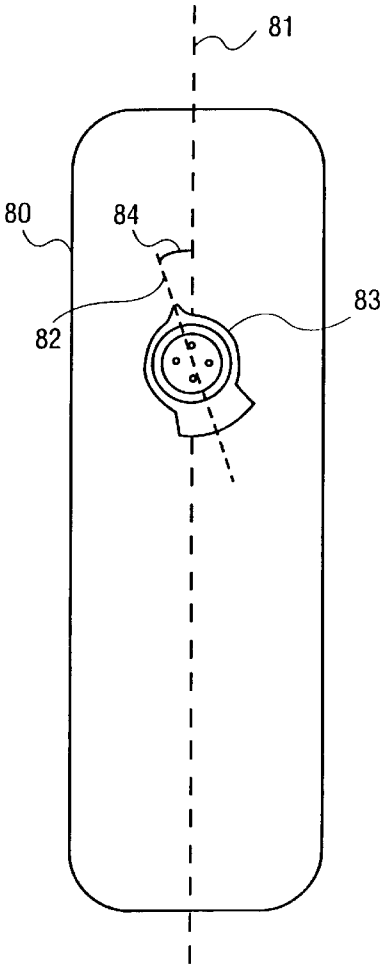
FIGS. 6A and 6B show two different positions of a boot attachment member in accordance with the teachings of the present invention.
Figure 6A:
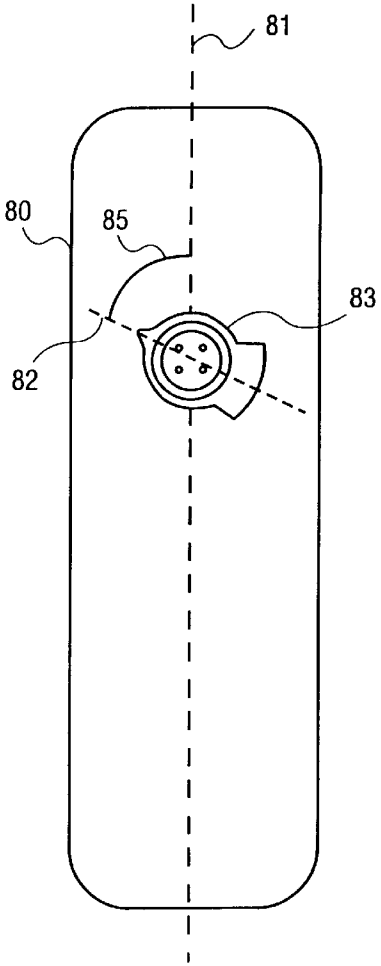

Because locking ring 2 and stopping member 32 are adjustable, as described in more detail below, the initial position of boot attachment member 1 can be the user's ride position, as shown in FIG. 6A, where the user's front boot points primarily to the side of the snowboard. The adjustability of locking ring 2 also allows the intermediate position of boot attachment member 1 to be a more comfortable non-ride position for the user's front boot, as shown in FIG. 6B, such that the user's front boot points primarily to the front of the snowboard rather than the side of the snowboard. In such a non-ride position, the user can more easily push himself or herself along flat surfaces with a free back boot. The tasks of mounting and dismounting a ski lift are also made easier. Although the present invention has particular applicability to a snowboard user's front boot, it is appreciated that the present invention is not limited to use with a user's front boot. The fact that the present invention allows the user to swivel boot attachment member 1 without using his or her hands enables the user to quickly transition from non-ride to ride positions. This is especially useful after the user dismounts a ski lift or when the user moves from a flat terrain to a downwardly sloped terrain.

With continued reference to FIG. 1C, an unassembled boot binding according to one embodiment of the present invention is shown. Boot attachment member 1 has a recess 36 that encircles opening 35 in boot attachment member 1. Locking ring 2 has a flange section 99, which extends around part of the circumference of locking ring 2 according to the desired placement of slots 6*a* and 6*b*, which are formed in flange section 99. Flange section 99 terminates at single-angled portions 7*a* and 7*b*. Locking ring 2 has a first planar surface 23 and a second planar surface 24 divided by shoulders 275. Flange section 99 extends above and outward from second planar surface 24. Flange section 99 engages with recess 36 of boot attachment member 1 while the remaining portions of locking ring 2 fit within opening 35. In one embodiment, locking ring 2 is made of anodized aluminum and treated with liquid Teflon to facilitate smooth rotation between locking ring 2 and boot attachment member 1. To provide greater wear resistance and smoother rotation, those portions of the boot attachment member 1 that are in sliding contact with locking ring 2 may be made of titanium nitride. When locking ring 2 is positioned within opening 35 of boot attachment member 1, the top surface of flange section 99 is level with the top surface of boot attachment member 1. First planar surface 23 of locking ring 2 is also level with the surface of recess 36. It is important to note that the invention is not limited to any one metal or rotation-facilitating material. For example, to provide greater wear resistance and smoother rotation, titanium nitride can also be used for parts that are in constant contact with each other.

A cam 95 has a circular main body 26 that is placed within the center opening 25 of locking ring 2. Cam 95 has an arm 27 that extends outward from main body 26. The bottom of arm 27 has a stepped portion 28, which rests on first planar surface 23 of locking ring 2 when main body 26 is positioned within center opening 25. The distal end 29 of arm 27 is configured to accommodate the attachment of stopping member 32. In one embodiment, double-angled portions 33*a* and 33*b* are identical. In an alternative embodiment, the stopping member has only one double-angled portion adjacent to the stopping portion. Stopping member 32 may be integrally formed with arm 27 of cam 95. The top surface of stopping member 32 is preferably at a slightly higher level than the top surface of cam 95. In one embodiment of the invention, cam 95, stopping member 32, locking ring 2 and securing plate 3 define a positioning assembly of the boot binding. It should be noted that the invention is not limited to a particular positioning assembly design.

Securing plate 3 is placed over locking ring 2 within the boundary defined by flange section 99 such that the bottom surface of securing plate 3 contacts second planar surface 23 and the top surface of cam 95. After securing plate 3 is placed within locking ring 2, the top surface of securing plate 3 is level with the tops of flange section 99 and stopping member 32. An advantage of the present invention is that the arrangement and dimensions of the binding results in a binding having a low-profile.

When main body 26 of cam 95 is centered within opening 25 (see FIG. 4B) a through path is provided between bolt holes 5 of securing plate 3 and the underlying snowboard (not shown). Once bolted to the snowboard, securing plate 3 provides a downward force to locking ring 2, cam 95 and boot attachment member 1. It is important to note that securing plate 3 should not be screwed down so tightly that the resulting downward force is so large as to prevent boot attachment member 1 from being rotated. The fact that securing plate 3 presses down on second planar surface 24 rather than flange section 99 helps ensure that the downward force of securing plate 3 does not prevent boot attachment member 1 from being rotated. An important feature of the present invention is that the user may adjust the radial position of locking ring 2 and cam 95 prior to affixing securing plate 3 to the snow board. The radial position of locking ring 2 is selected by rotating locking ring 2 within opening 35 of boot attachment member 1. The radial position of cam 95, and hence, the radial position of stopping member 32, is selected by rotating arm 27 along first planar surface 23 between shoulders 275. Note that when securing plate 3 is unscrewed and the downward force is relaxed, locking ring 2 can be rotated within opening 35 and front cam 95 can be rotated such that arm 27 is rotated along recessed portion 24 within the boundaries fixed by the ends of raised portion 23.

An salient feature of the present invention is that the boot binding may be rotated to accommodate either a right-foot-forward position or a left-foot-forward position. The symmetric configuration of locking ring 2 and cam 95 and stopping member 32 permit the binding to be easily and quickly rotatable between the right-foot-forward and left-foot-forward riding positions.

With continuing reference to FIG. 1C, housing 15 is attached to boot attachment member 1 by screws (not shown) that are inserted through pairs of threaded holes 20*a* and 31*a*, 20*b* and 31*b*, and 20*c* (not shown) and 31*c*. A pin 14 inserted through holes 18*a*, 17 and 18*b* rotatably couples release arm 10 to housing 15. A pin 13 rotatably secures release arm 10 to main body 11, which rests within nook 19 in boot attachment member 1, by being inserted through holes 22*a*, 16 and 22*b*. Boot attachment member 1 is shown having a recess 90 and holes 91 for mounting heel clip 401. A recess 92 and holes 93 are provided for mounting toe clip 402. It is to be understood that the invention is not limited to boot attachment members having such features. In one embodiment, as described more fully below, pads 37 are secured to the bottom of boot attachment member 1.

Figure 2A:
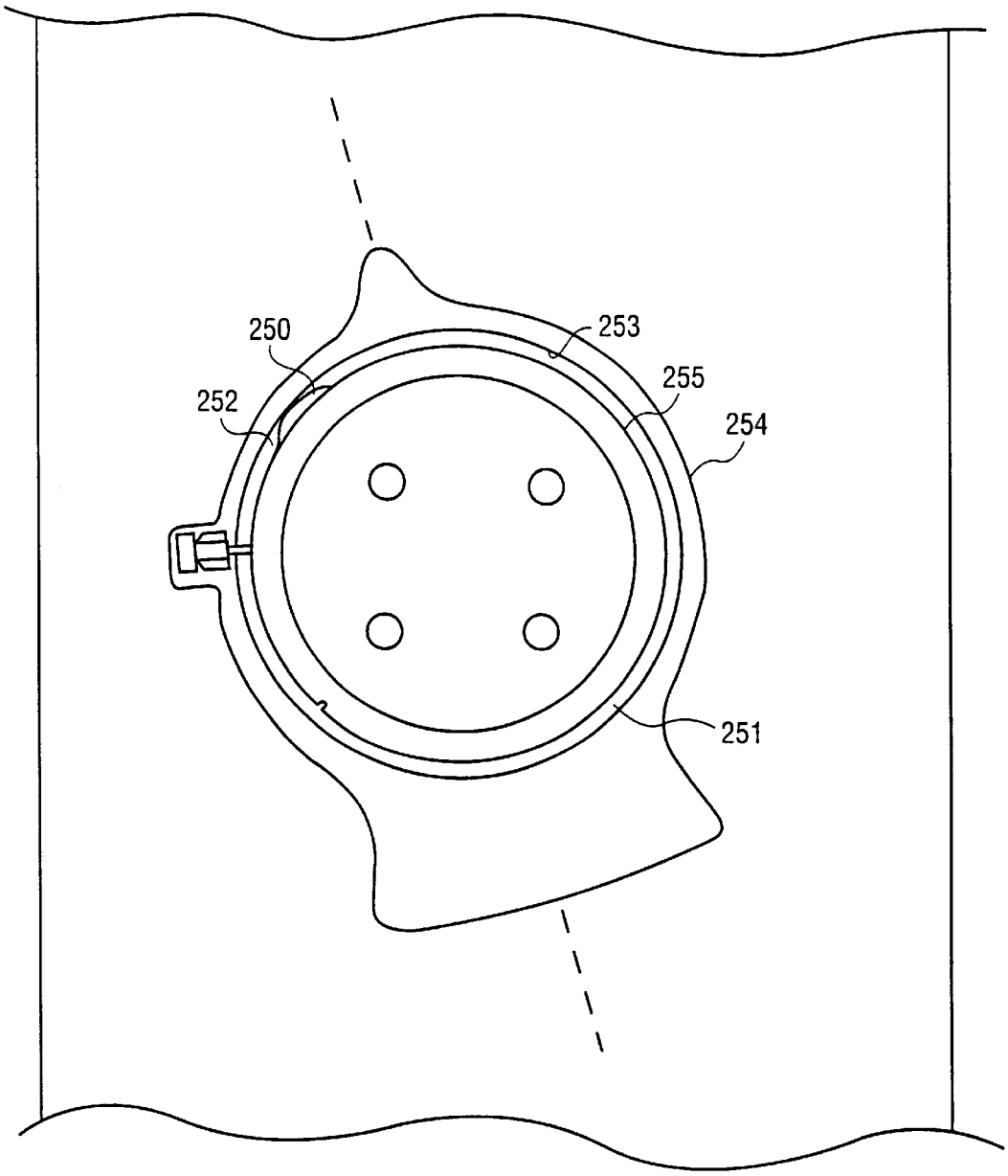
FIGS. 2A and 2B show top views of two positions of an assembled boot binding with an alternative stopping arrangement in accordance with the teachings of the present invention.
Figure 2B:
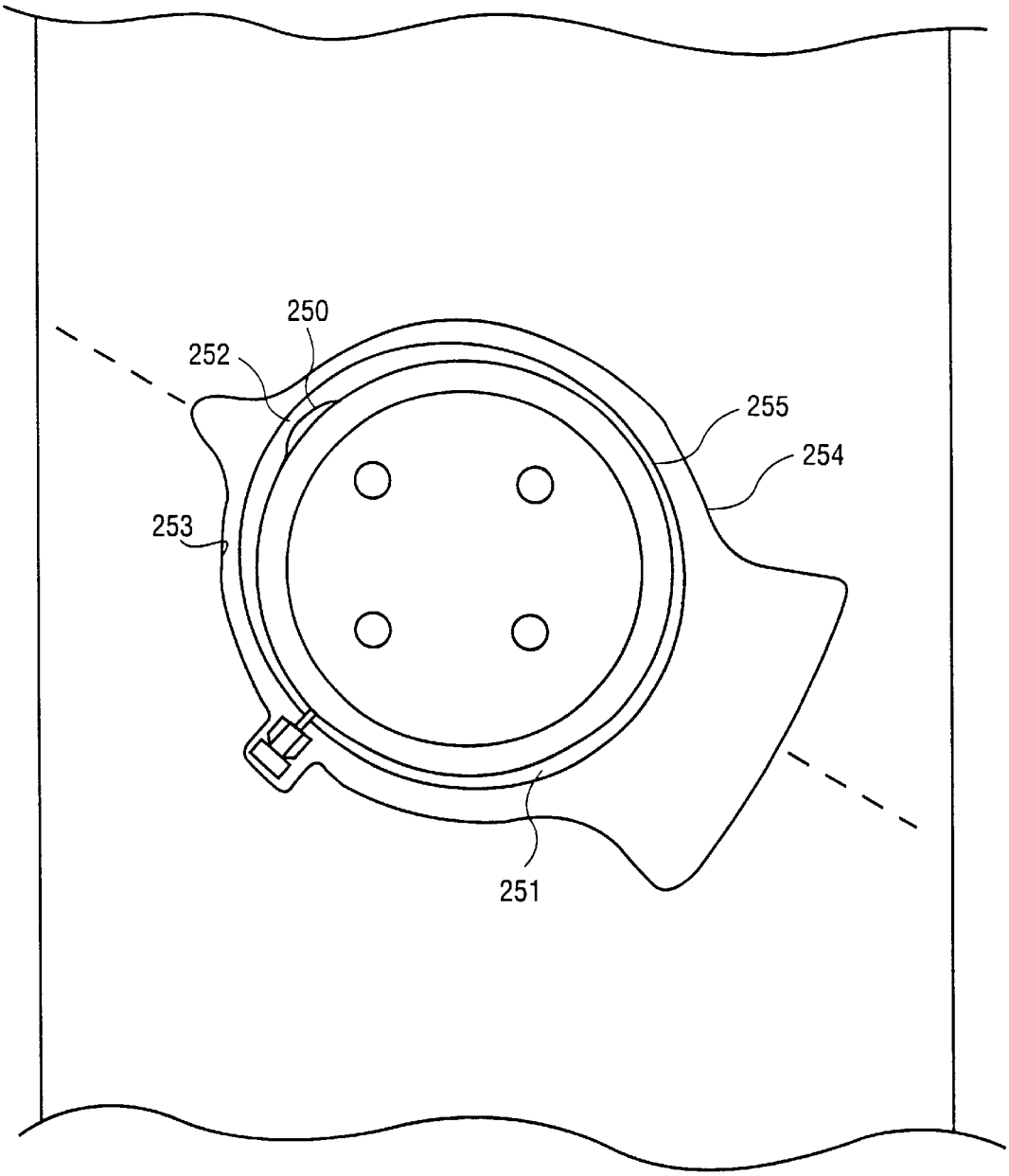

In one embodiment of the invention, as shown in FIG. 2A, a wedge 250 protruding from the edge of locking ring 2 can be used in lieu of the tab-stopping member arrangement of FIGS. 1A–1C to hold a boot attachment member 254 in an intermediate position. In one embodiment, wedge 250 is replaceably attached to the edge of circular locking ring 255, which is located within an elliptical opening 251 of boot attachment member 254. In another embodiment, wedge 250 is integrally formed with locking ring 255. Wedge 250 can also be located on inner wall 253 of opening 251. As boot attachment member 254 is rotated, gap 252 between wedge 250 and inner wall 253 of elliptical opening 251 decreases until wedge 250 presses against inner wall 253 of elliptical opening 251. Wedge 250 pressing against inner wall 253 is part of a first locking arrangement. The size, shape and material of wedge 250 can be chosen to accommodate the user's preferences regarding the amount and ease of rotation. For example, in one embodiment, the surfaces of wedge 250 and inner wall 253 are textured to adjust the frictional force between contacting surfaces. In another embodiment, wedge 250 is made of metal. In yet another embodiment, the opening in the boot attachment member is circular and the locking ring is elliptical. The wedge and tab-stopping member assemblies are merely illustrative and should not be used to limit the invention in any way. It should be noted that a separate, second locking arrangement, such as the tab-slot locking arrangement described above, is still needed to secure boot attachment member 254 in a locked position, as shown in FIG. 2B.

Figure 3A:
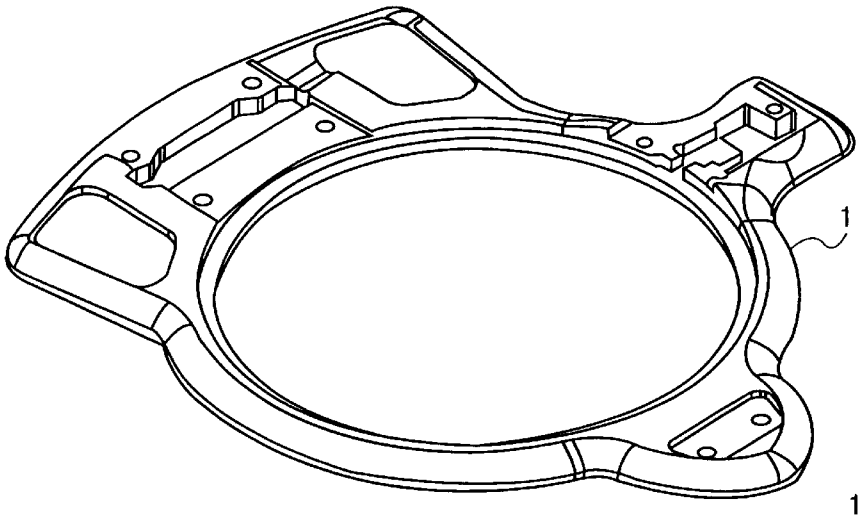
FIGS. 3A and 3B show top and bottom angled views, respectively, of a boot attachment member in accordance with the teachings of the present invention.
Figure 3B:
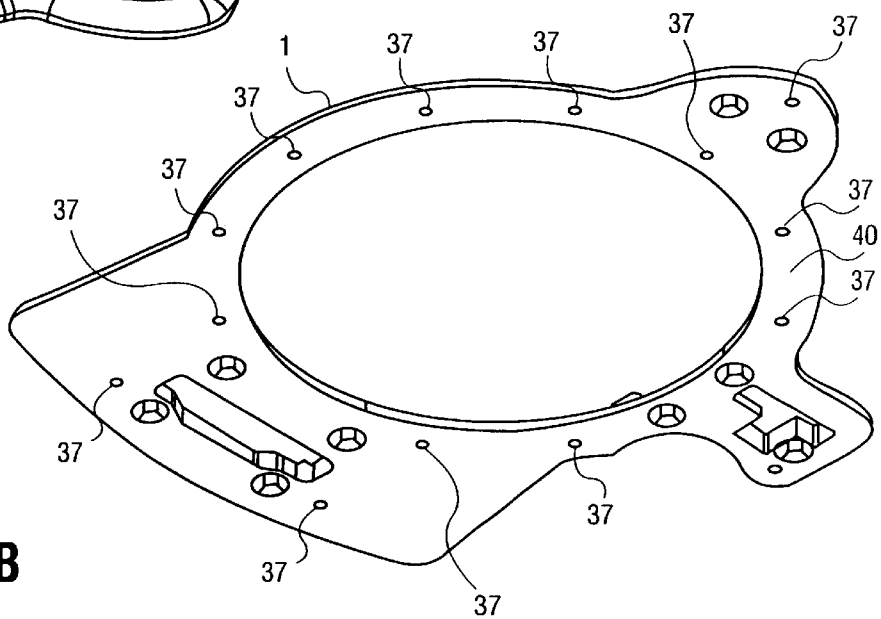

FIGS. 3A and 3B show top and bottom angled views, respectively, of boot attachment member 1. Pads 37 can be placed on bottom surface 40 of boot attachment member 1. Because pads 37 act as spacers between boot attachment member 1 and the underlying snowboard, pads 37 contact the snowboard when boot attachment member 1 is attached to the snowboard. Pads 37 can be nylon or any other suitable material having a surface hardness less than that of the snowboard. This feature inhibits scratching of the snowboard by boot attachment member 1. In one embodiment, pads 37 are made of a material, or a series of materials that provide shock absorption and/or cushioning support to the user as he or she stands on and rides the snowboard.

Figure 4A:
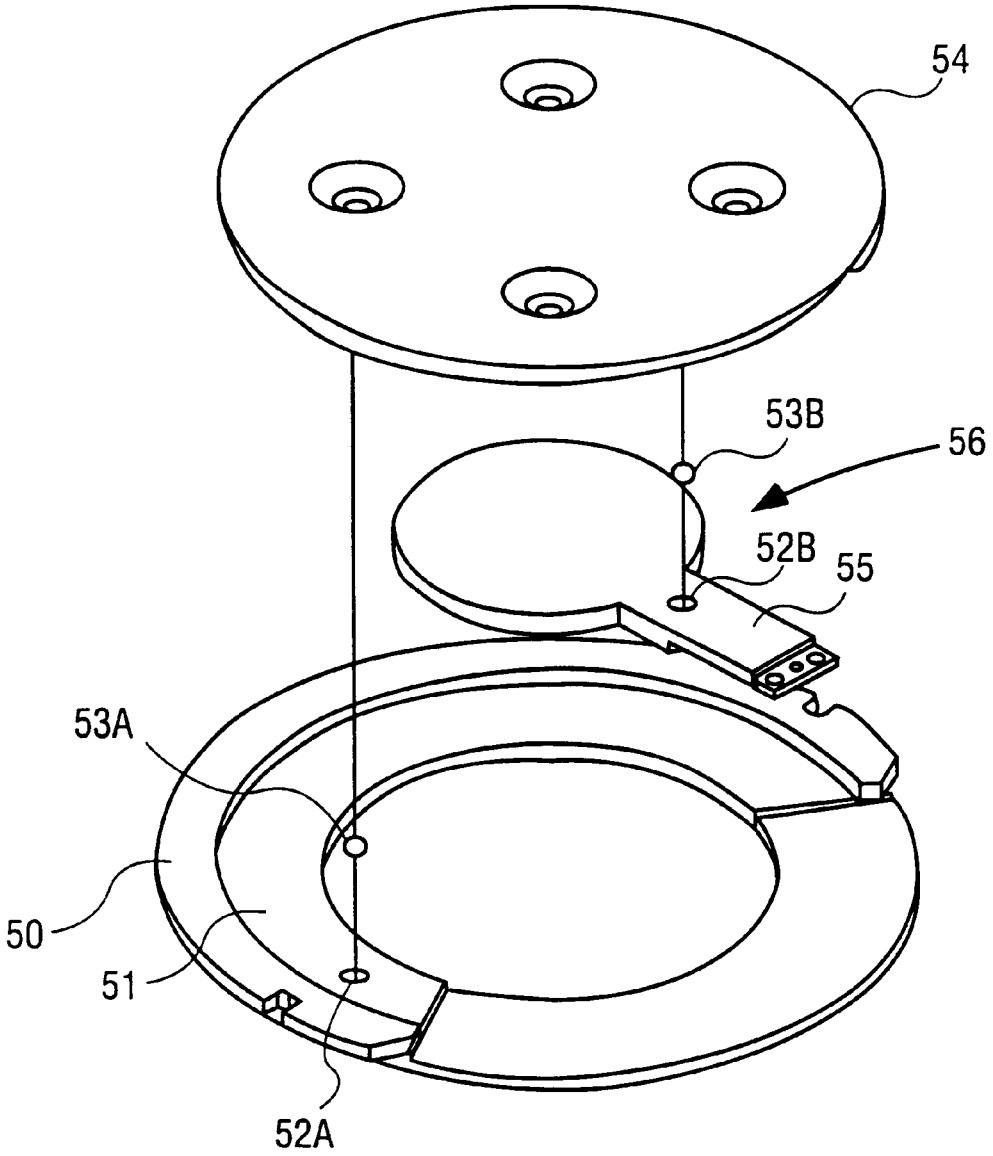
FIGS. 4A and 4B show top and bottom angled views, respectively, of a positioning assembly of a boot binding in accordance with the teachings of the present invention.
Figure 4B:
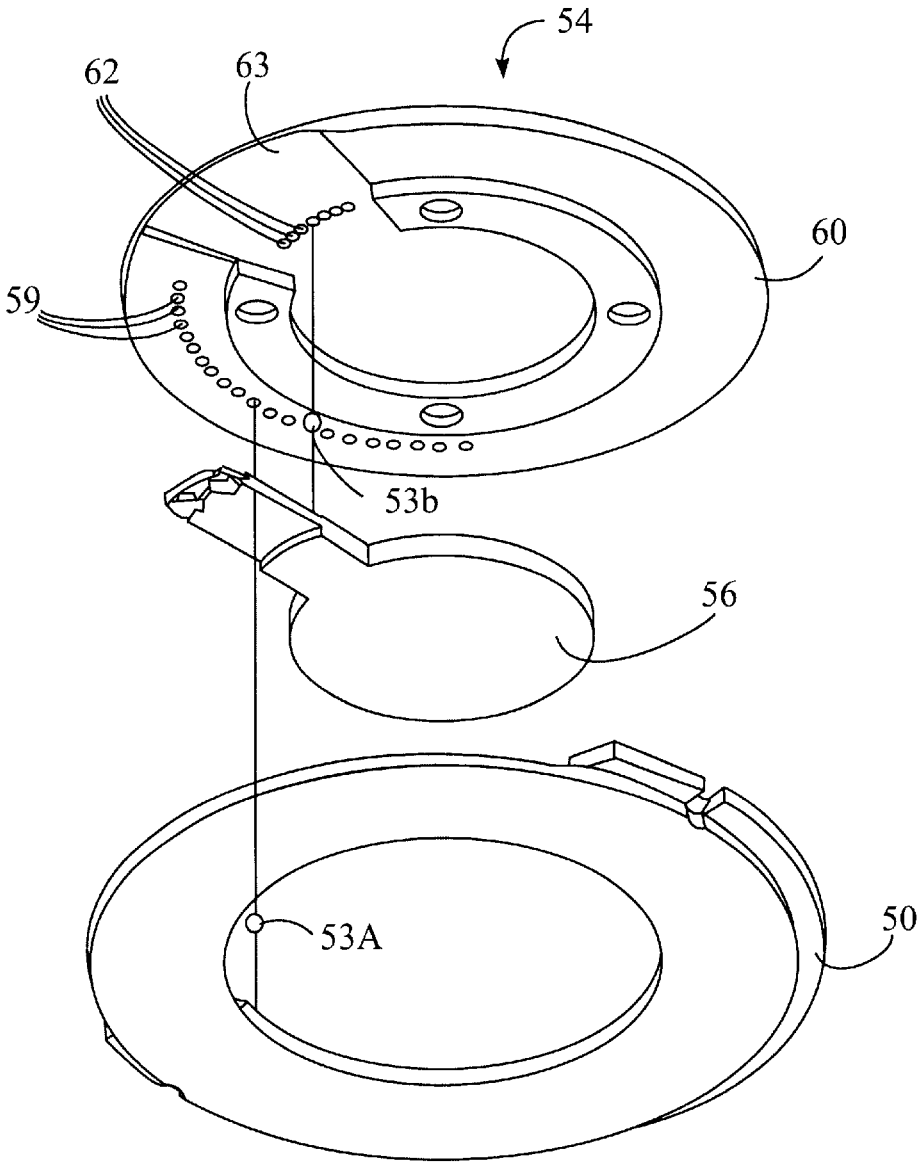

FIGS. 4A and 4B show top and bottom angled views, respectively, of a positioning assembly used in a boot binding according to yet another embodiment of the invention. Second planar surface 51 of locking ring 50 has at least one indentation 52*a* which, in one embodiment, houses a spherical member 53*a* that extends at least partially above second planar surface 51. Arm 55 of cam 56 has an indentation 52*b* which, in one embodiment, houses a spherical member 53*b* that extends at least partially above arm 55. In an alternative embodiment, bumps that extend from second planar surface 51 and arm 55 are used instead of the spherical members. Securing plate 54 has a plurality of indentations 59 and 62 formed on the bottom surfaces 60 and 63, respectively, of securing plate 54. When securing plate 54 is affixed to the underlying snowboard, bottom surface 60 of a securing plate 54 presses against second planar surface 51 of locking ring 50 and bottom surface 63 presses against cam 56. Spherical members 53*a*, 53*b* engage one of the plurality of indentations 59 and 62 to prevent locking ring 50 and cam 56 from inadvertently rotating during rotation of the boot attachment member (not shown).

Figure 5A:
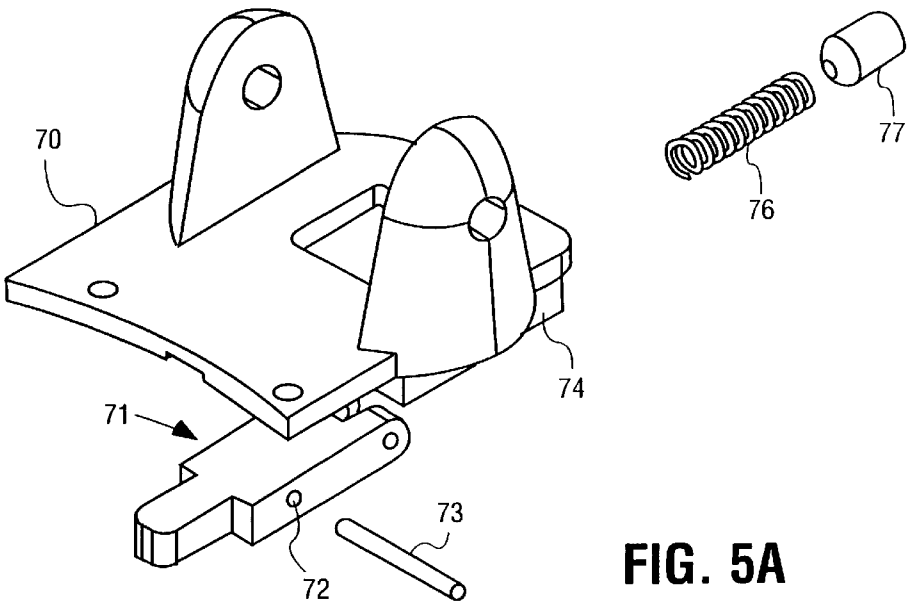
FIGS. 5A and 5B show top and bottom angled views, respectively, of a locking device in accordance with the teachings of the present invention.
Figure 5B:
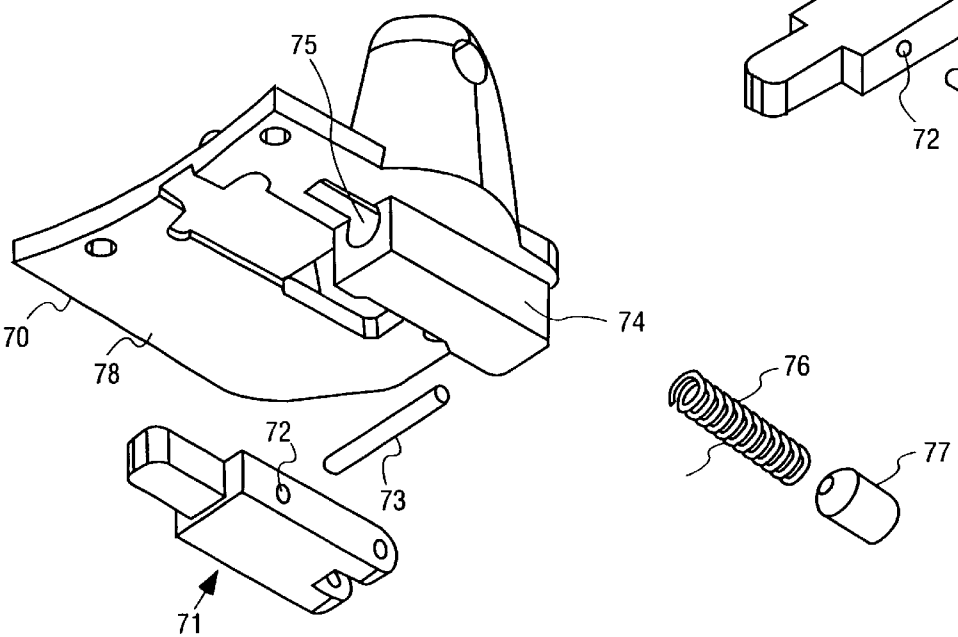

FIGS. 5A and 5B show top and bottom angled views, respectively, of a locking device according to one embodiment of the invention. A main housing 70 has a spring housing 74 formed on a bottom surface 78 of main housing 70. Spring housing 74 has a bore 75 that accommodates a spring 76 and a plug 77, against which spring 76 is compressed. A locking member 71 has a hole 72 into which a pin 73 is inserted. The exposed end of pin 73 is orthogonally impinged upon by the end of spring 76 that is extending out from bore 75. Thus, via pin 73, spring 76 forces locking member 71 into a locked position, as mentioned earlier with reference to FIG. 1A. The position of spring 76, and hence the biasing force provided by spring 76, can be varied according to the placement of plug 77 within bore 75.

FIGS. 6A and 6B show two different positions of a boot attachment member 83 in accordance with the teachings of the present invention. For purposes of clarity, a back foot binding is not shown on snowboard 80. Snowboard 80 has a longitudinal axis 81, and boot attachment member 83 has a boot axis 82, which is aligned with the user's attached boot (not shown). FIG. 6A shows boot attachment member 83 in a ride position, which places the user's front boot at a conventional angle 85 for snowboarding t o down a slope. The angle 85 between longitudinal axis 81 and boot axis 82 is normally in the range of 40 to 90 degrees when boot attachment member 83 is in a ride position.

FIG. 6B shows boot attachment member 83 in a non-ride position. As mentioned earlier, the user can use a non-ride position to place his or her front boot at a more comfortable angle to facilitate movement on flat areas. A non-ride position is also helpful for getting on, sitting on, and getting off ski lifts. The angle 84 between longitudinal axis 81 and boot axis 82 is typically in the range of 0 to 30 degrees when boot attachment member 83 is in a non-ride position. It should be noted that FIGS. 6A and 6B are applicable to users who lead with their right foot. For users who lead with their left foot, the size of the angles are the same, but are simply measured on the opposite side of longitudinal axis 81.

Figure 8A:
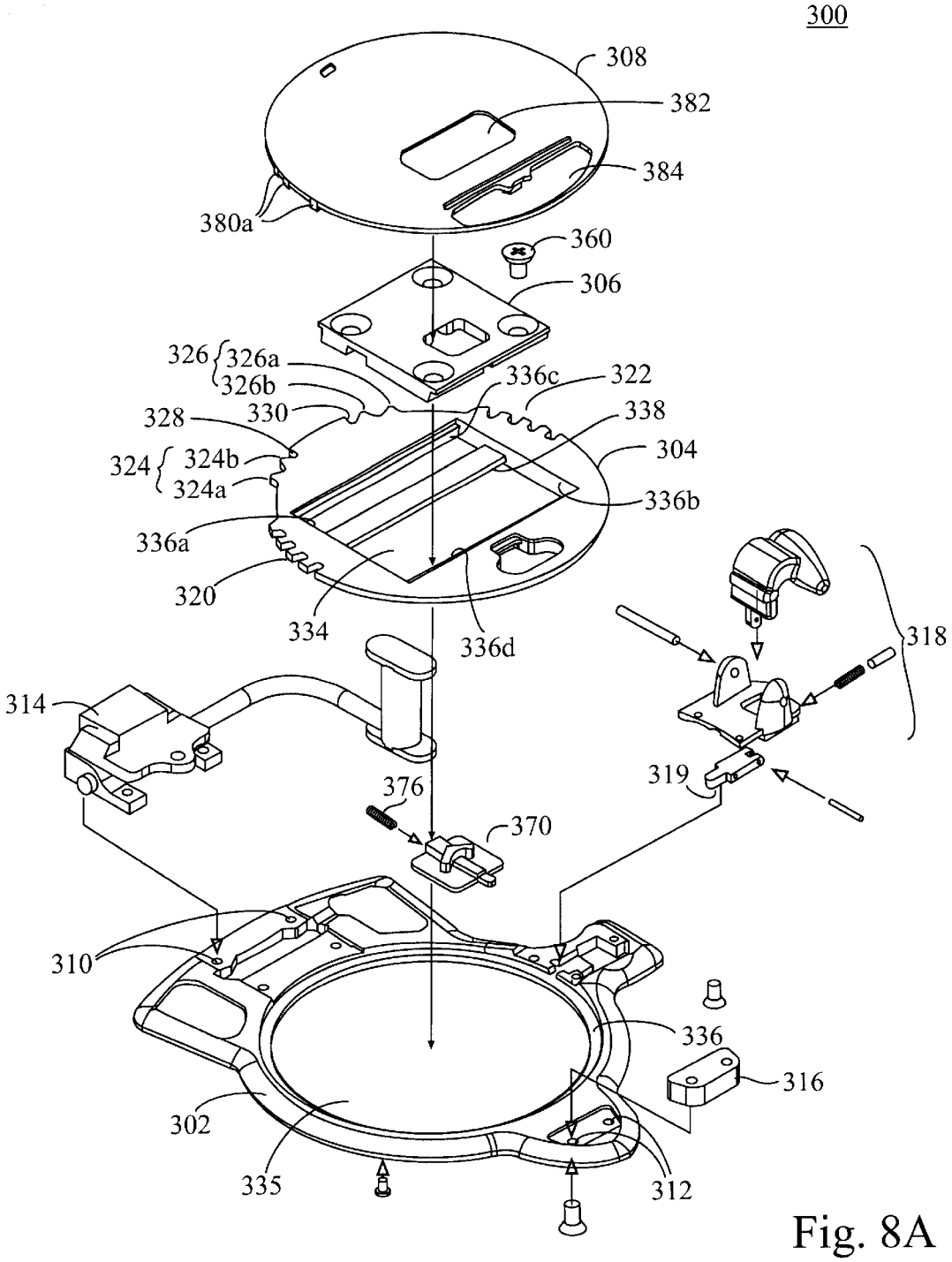
FIG. 8A is an expanded view of a boot binding in accordance with another embodiment of the present invention.
Figure 8B:
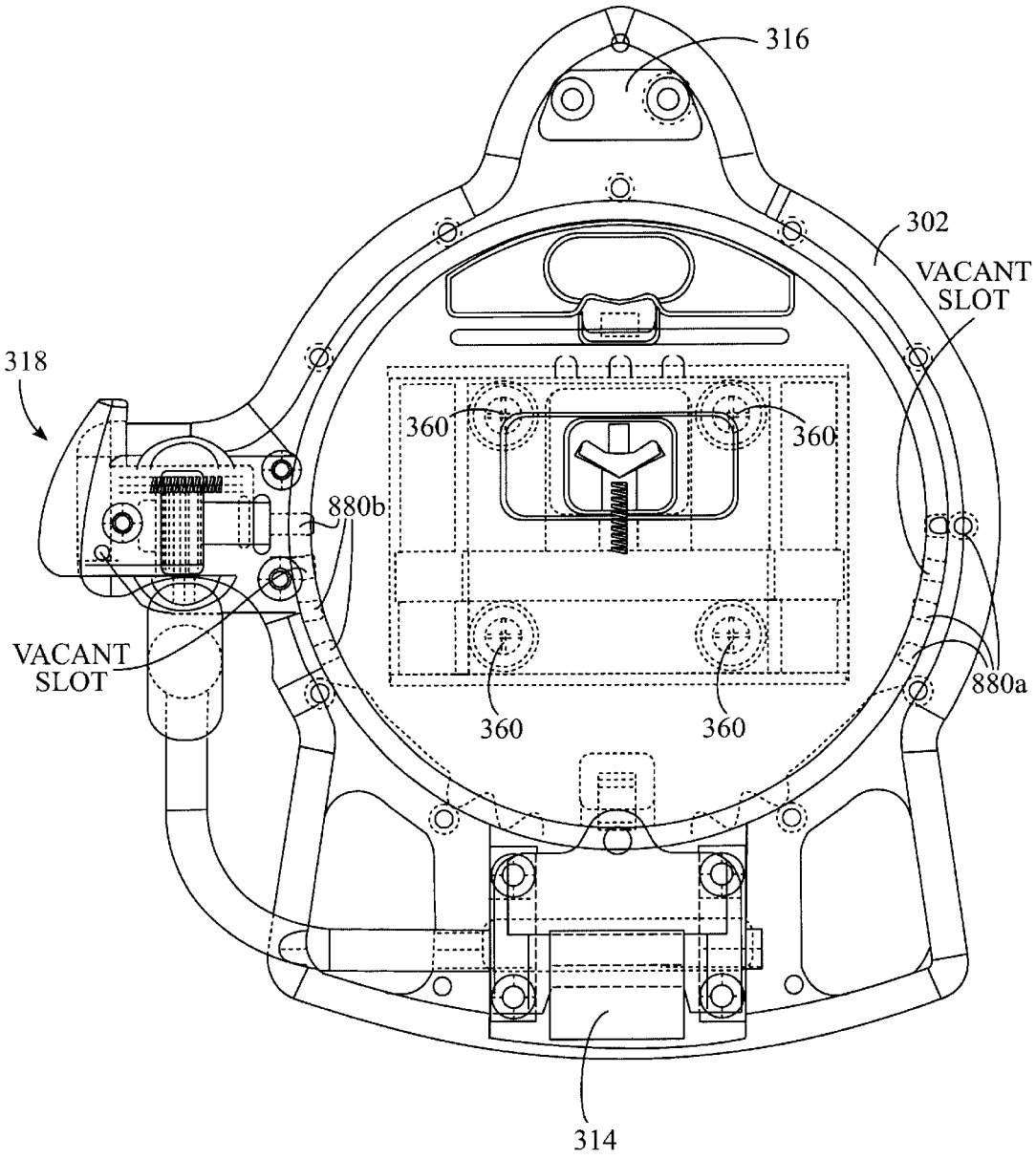
FIGS. 8B and 8C are assembled top views of the boot binding shown in FIG. 8A.
Figure 8C:
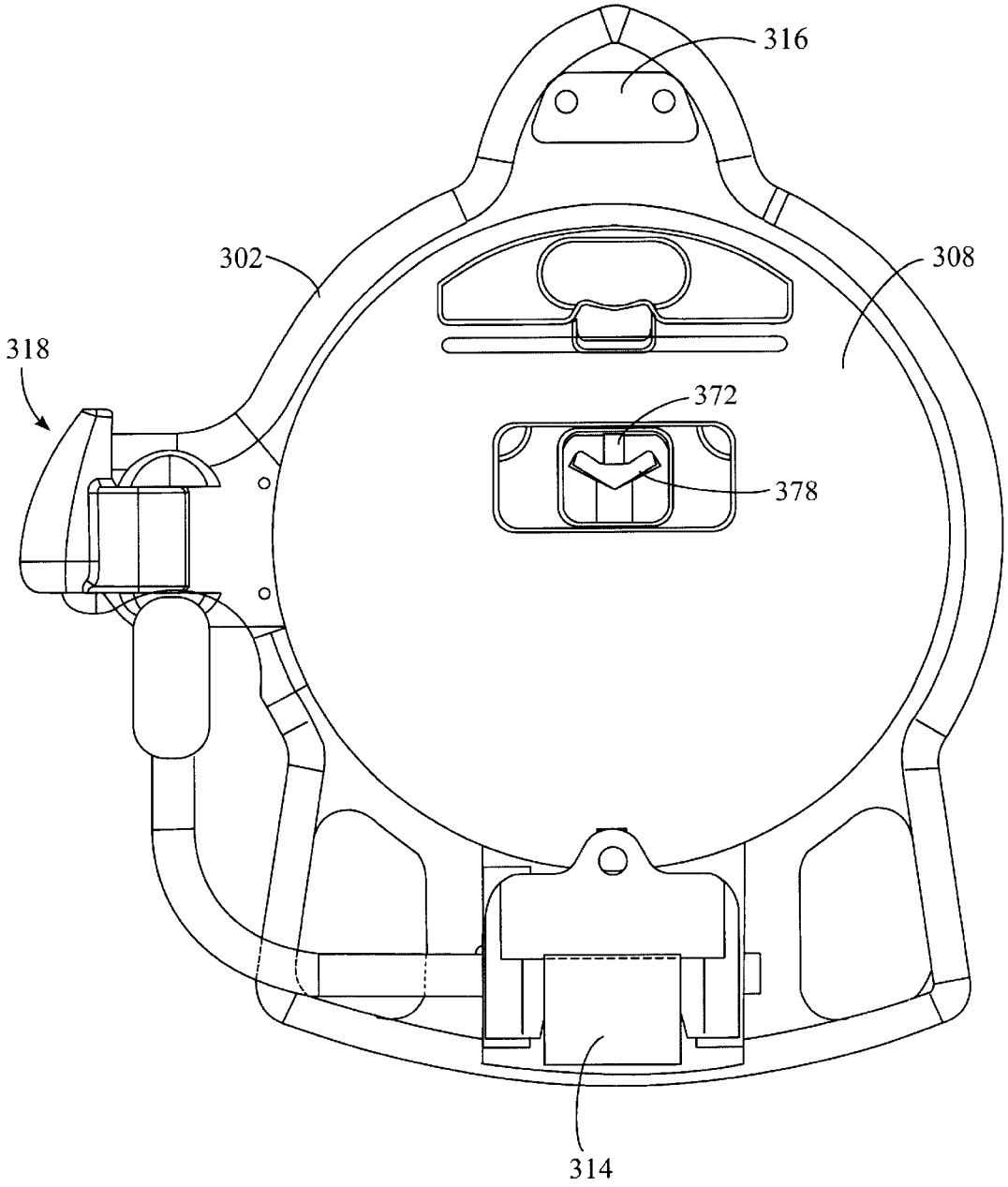

FIGS. 8A through 8D show a boot binding 300 in accordance with another embodiment of the invention. Boot binding 300 includes a boot attachment member 302, a locking plate 304, a stationary plate 306, and a cover 308. Boot attachment member 302 has holes 310 and 312 to facilitate the attachment of a heel clip 314 and a toe clip 316, respectively. The heel and toe clip arrangement illustrated in FIGS. 8A–8C represents a step-in type binding. As previously noted, the present invention is not limited to a step-in binding, but is applicable to any of a number of binding types.

Locking plate 304 is supported within an opening 335 in boot attachment member 302. More particularly, locking plate 304 rests upon and is in sliding engagement with a recess/shoulder 336 that encircles opening 335. In FIG. 8 shoulder 336 is shown completely encircling opening 335. In an alternative embodiment, shoulder 336 may not completely encircle opening 335. For example, in order to decrease the contact surface area between locking plate 304 and boot attachment assembly 302, shoulder 336 may include a series of spaced apart shoulder segments.

Locking plate 304 has a generally circular shape. A first and second set of spaced apart slots 320 and 322 are symmetrically located along the outer periphery of locking plate 304. A first and second set of double-angled stopping members 324 and 326 are also symmetrically located along the outer periphery of locking plate 304. The double-angled stopping members are preferably located at a midpoint between the first and second set of slots 320 and 322. As will be discussed in more detail below, the symmetric configuration of locking plate 304 permits the boot binding to be rotated to accommodate either a left-foot-forward riding position or a right-foot-forward (goofy foot) riding position.

The engaging surfaces of locking plate 304 and shoulder 336 may be coated with a lubricious material to reduce to the contact friction between the two members. In addition, the locking plate 304 and shoulder 336 are preferably made of a wear resistant material such as titanium nitride. Alternatively, a thin layer of a wear resistant material may be deposited onto the engaging surfaces of locking plate 304 and shoulder 336.

In an alternative embodiment, a bearing or set of bearings (not shown) may be positioned between the mating faces locking plate 304 and boot attachment member 302 to facilitate the rotation of the boot attachment member 302.

Figure 8D:
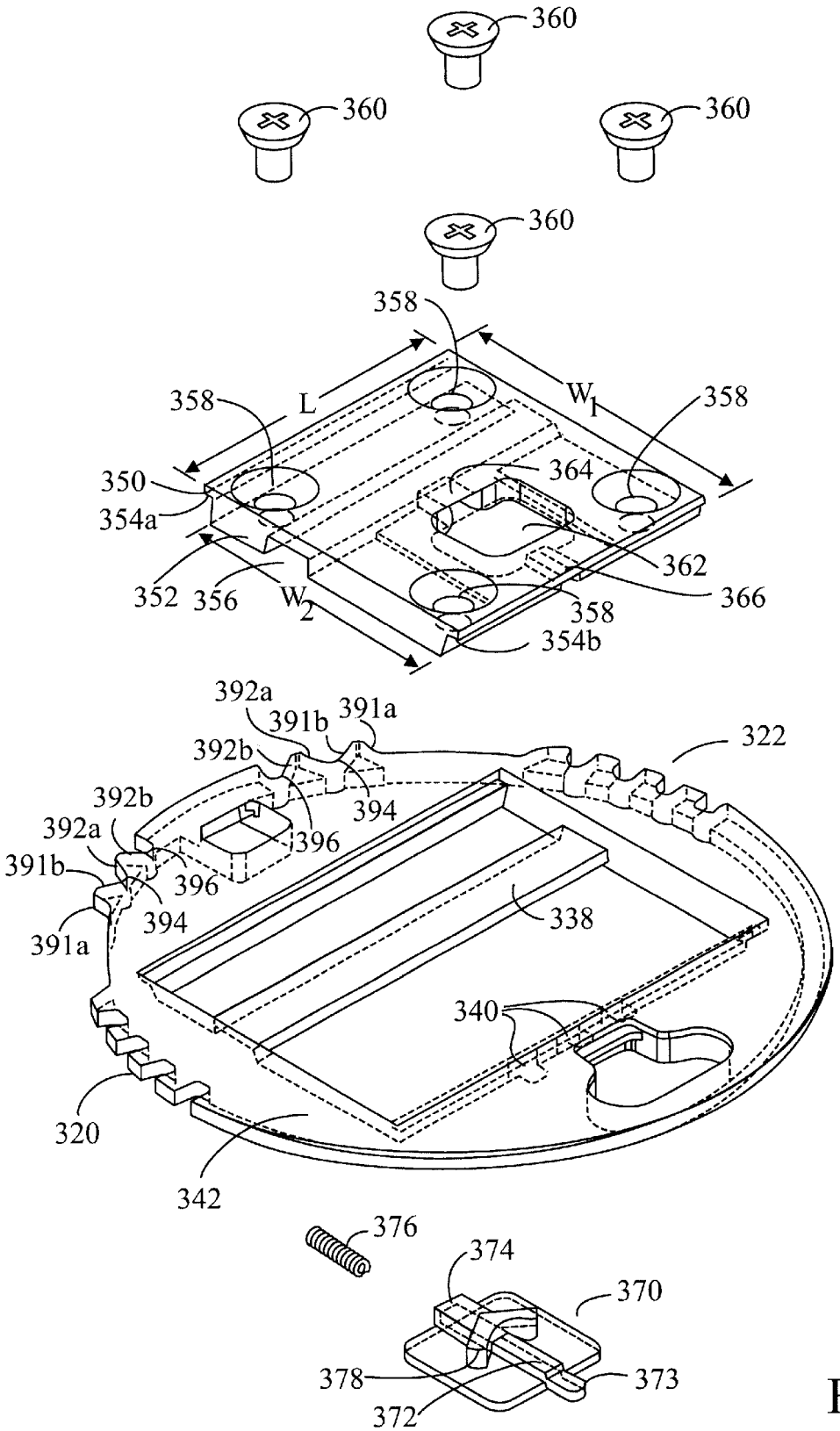
FIG. 8D is an enlarged view of the locking plate and stationary plate shown in FIG. 8A.

Locking plate 304 includes an opening 334 having a first side 336*a*, second side 336*b*, a third side 336*c*, a fourth side 336*d*, and a transverse beam 338 extending between the first and second sides. As shown in FIG. 8D, a plurality of spaced apart slots 340 are located within the fourth side 338*d* of opening 334.

Stationary plate 306 is used to secure the boot binding 300 to a snowboard (not shown). In one embodiment, stationary plate 306 has a substantially rectangular shape and includes an upper portion 350 and a lower portion 352. The length, L, of upper and lower portions 350 and 352 are the same. The width, $W_1$, of the upper portion 350 is sized greater than the width, $W_2$, of the lower portion 352 to create shoulders 354*a* and 354*b*. Width, $W_2$, is slightly smaller than the width of the sides 336*a* and 336*b* of opening 334 in locking plate 304. Shoulders 354*a* and 354*b* rest on the upper surface 342 of locking plate 304. The length, L, of stationary plate 306 is smaller than the length of sides 336*c* and 336*d* of opening 334. A transverse recess 356 extends across the length of the stationary plate 306 and is positioned and sized to mate with the transverse beam 338 of locking plate 304. Bolt holes 358 enable the stationary plate 306 to be secured to a snowboard (not shown) by screws or bolts 360.

An opening 362 and recesses 364 and 366 in stationary plate 306 house a locking assembly 370. Locking assembly 370 includes plunger 372 which is biased outwardly toward slots 340 located in the side 338d of opening 334 in locking plate 304. The distal end 373 of plunger 372 is slidable within recess 366, whereas the proximal end 374 is slidable within recess 364. A spring or other biasing member 376 acts upon the proximal end 374 of plunger 372 to continuously urge the distal end 373 of the plunger toward the slots 340 in locking plate 304. Finger posts 378 on plunger 372 permit a user to exert an opposing force to the biasing member 376 to retract the distal end 373 of the plunger 372 from slots 340.

When the boot binding is fully assembled onto a snowboard, the stance position of a user is adjustable by retracting the distal end 373 of plunger 372 from one of slots 340 in locking plate 304. When the distal end 373 is fully retracted, the boot attachment member 302 is transversely slidable in a direction along the length of stationary member 306. When the stance position of the boot attachment member 302 is properly adjusted, the user releases the plunger finger posts 378 to allowing the distal end 373 of plunger 372 to engage with one of slots 340, thereby locking the stance position of the boot attachment member 302.

A locking device 318 is mounted to the boot attachment member 302. The locking devices functions in the same manner as the locking device described in conjunction with the embodiment of FIGS. 1A–1C. Locking device 318 includes a tab or locking member 319 that is biased inwardly toward locking plate 304. When the stationary plate 306 is secured to a snowboard, the boot attachment member 302 is in a rotatable, sliding engagement with locking plate 304. The angular position of the boot attachment member is adjustable by the user retracting locking member 319 from one of slots 320 or 322 and rotating the boot attachment member until the locking member is aligned with one of another of slots 320 or 322. For example, when binding 300 is used as a left-foot-forward binding, locking member 319 engages one of slots 322 to hold the boot attachment member 302 in a locked angular or radial position. The user may adjust the angular position of the boot attachment member 302 by retracting the locking member 319 from one of slots 322 and rotating the boot attachment member until locking member 319 engages another one of slots 322. In FIG. 8, locking plate 304 is shown having four slots 322. It is appreciated that the locking member may have more than four slots, or fewer than four slots.

A cover 308 having one or more sets of downwardly protruding members 380 is attachable to binding 300. In the embodiment of FIG. 8, cover 304 has two sets of protruding members 380*a* and 380*b* which are aligned with slots 320 and 322 in locking plate 304, respectively. Each of sets 380*a* and 380*b* includes three protruding members. Cover 308 is attached to the binding 300 by inserting the protruding members 380*a* and 380*b* into the corresponding slots 320 and 322 in locking plate 304. As shown in FIG. 8B, when cover 308 is attached to locking plate 304 one slot remains vacant in each of the set of slots 320 and 322. The slots that remain vacant are the only slots that are engageable with locking member 319, and thus define the user's preferred angular riding position. Each of protruding members 380 preferably has a curved outer surface that extends at least partially outside slots 320 or 322. This ensures that when the boot attachment member 302 is rotated that locking member 319 will not catch within an occupied slot. A set of covers having different protruding member configurations may be provided so that a user may select from different angular riding positions.

Cover 308 includes a first aperture 382 which exposes the finger posts 378 of plunger assembly 370. A second aperture 384 permits a user to grip the cover in order to remove it from the binding 300.

Figure 10A:
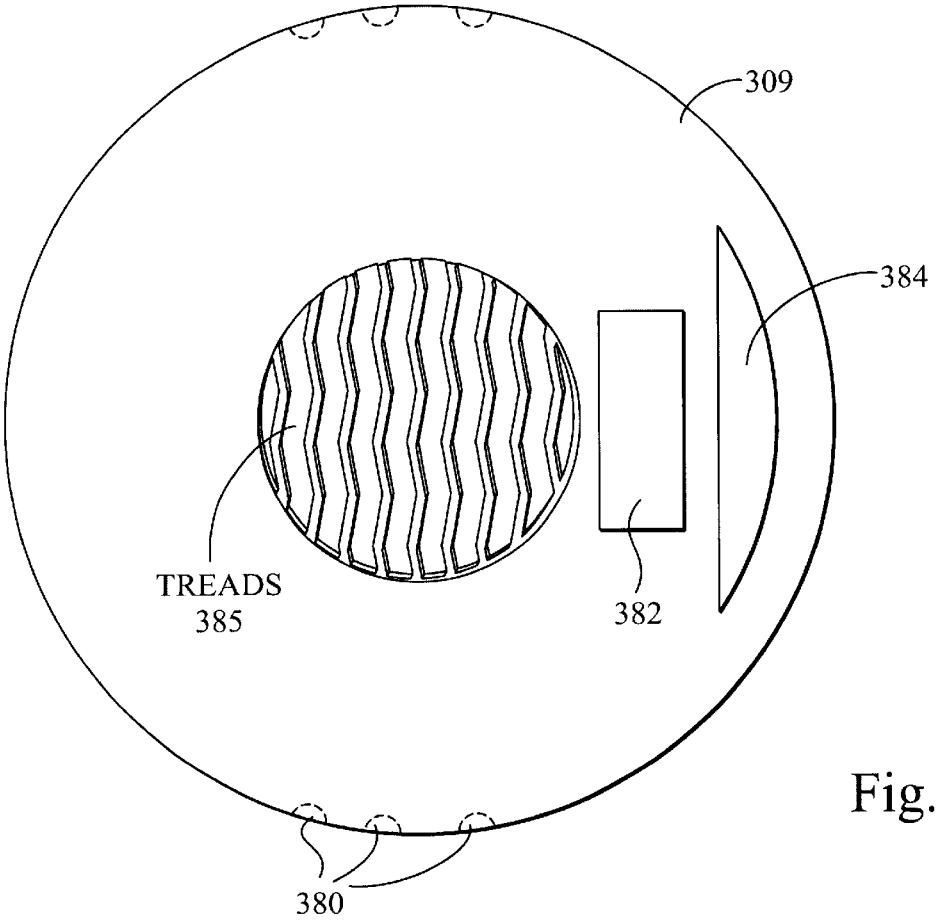
FIGS. 10A and 10B are top and side views, respectively, of a boot binding cover plate in one embodiment of the present invention.
Figure 10B:
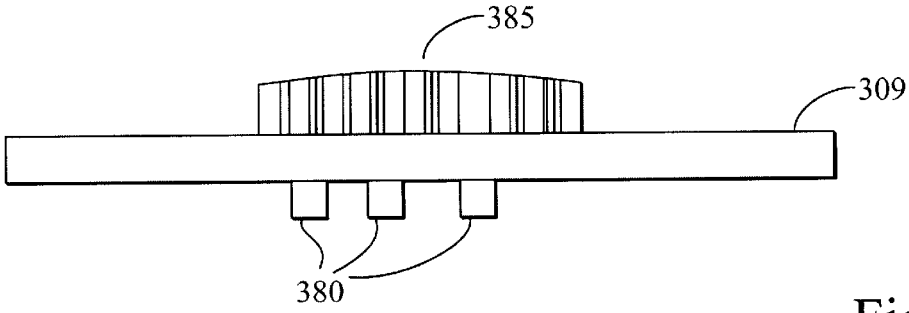

In one embodiment, cover 308 includes a compressible member 385 that extends upward from the top surface 309 thereof, as shown in FIGS. 10A and 10B. The compressible member 385 may include a foam material, elastomeric material, or any other material that is both deformable and capable of retaining its shape after it is deformed. In an alternative embodiment, the compressible member may include a spring or a spring loaded member. In other embodiments the compressible member may include a gel-filled membrane similar to the material used in bicycle seats, an air-filled membrane, or any combination shock absorbing materials or structures. The compressible member 385 is preferably located in a position such that the bottom center of a user's boot engages the member when the boot is secured with binding 300. Compressible member 385 exerts an upward force on the user's boot (not shown) to stabilize the boot within the binding. Boots secured within conventional step-in bindings tend to move within the binding during down-hill maneuvers. The upward force exerted by member 385 will inhibit such movement. In addition, compressible member 385 acts as a shock absorber.

To facilitate the rotational movement of the boot attachment member 302, compressible member 385 may be rotatably mounted to cover 308. Compressible member 385 may also be textured, have a tread pattern, or otherwise finished to achieve a particular stabilizing affect.

Figure 11A:
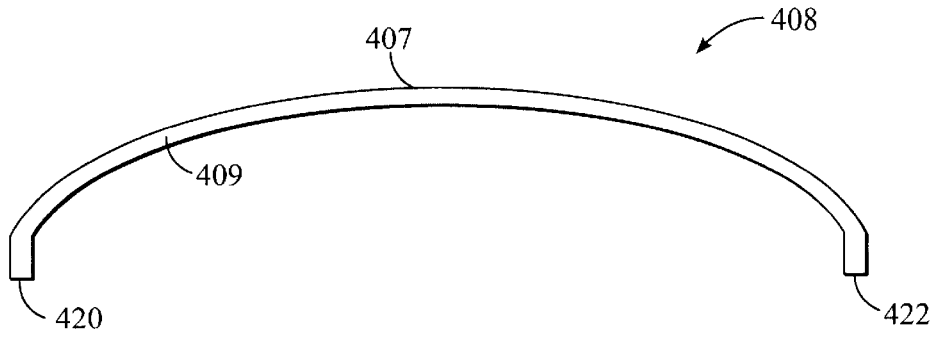
FIGS. 11A and 11B are cross-sectional side views of a boot binding shock absorber in another embodiment of the invention.
Figure 11B:
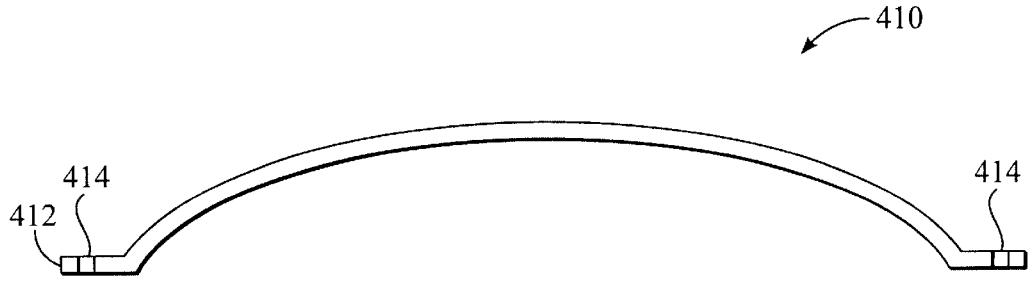

FIG. 11A shows a cross-sectional side view of a cover 708 in another embodiment of the invention. Cover 708 includes a flexible and resilient substrate 709 having an outward bow. Cover 708 also includes protruding members 720 and 722 that are insertable into slots 320 and 322 of locking plate 304, respectively. The apex 707 of cover 708 engages the bottom of a user's boot when the boot is locked into the binding 300. As the user steps into the binding, cover 708 deflects upon the application of a downward force applied by the bottom of the user's boot. Hence, when the user's boot is locked within binding 300, cover 708 exerts an upward force on the binding. Cover 708 may be made of a plastic material, a metal, or any other material or combination of materials that are both flexible and capable of substantially retaining its original form after having been compressed. In one embodiment, the upper surface of cover 708 is textured. In yet another embodiment, a skid resistant material is applied to the upper surface. These features enhance the stabilizing affect of the cover. Another advantage of cover 708 is that it acts as a shock absorber FIG. 11B shows a stabilizer/shock absorber 710 in another embodiment of the invention. The stabilizer/shock absorber 710 may be used with conventional snowboard bindings. The shock absorber 710 is attachable to a boot binding by bolt holes 714 located within a peripheral flange 712. In an alternative embodiment locking tabs may be used to attach the shock absorber to the boot binding. It is important to note, however, that the use of the shock absorber is not limited to any particular boot binding design, nor is it limited to a particular means of attachment.

As previously discussed, locking ring 304 includes two sets of double-angled stopping members 324 and 326. Each of the sets of stopping members includes two double-angled stopping members 324*a*, 324*b* and 326*a* and 326*b*. The double-angled stopping members serve the same function as described in the embodiments of FIGS. 1–7. In the embodiment of FIG. 8, two double-angled stopping members 324*a*, 324*b* or 32*6*, 326b are provided. Each of double-angled portions 324*a* and 326*a* have inner and outer slopes 391*a* and 391*b*, respectively. Each of double-angled portions 324*b* and 326*b* have inner and outer slopes 392*a* and 392*b*, respectively. The angle of slopes 391*a* and 391*b* are typically smaller than the angle of slopes 392*a* and 392*b*. For example, in one embodiment the angle of slopes 391*a* and 391*b* is typically in the range of 5 to 15 degrees, whereas the angle of slopes 392*a* and 392*b* is in the range of 20 to 30 degrees. In addition, stopping members 324*a* and 326*a* may have a smaller profile than stopping members 324*b* and 326*b*. By including two double-angled stopping members having progressive slope angles and/or smaller profiles, the user may rotate the boot attachment member 302 into one of two intermediate positions 394 or 395. The force necessary to move the boot attachment member 302 into the first intermediate position 394 is less than the force required to move the boot attachment member into the second intermediate position 396. The first intermediate position 394 may be chosen when the user desires a less forceful and quicker release from the intermediate position. Alternatively, the user may select the second intermediate position 396 when a more secure intermediate riding position is desired. A hard stop 328 or 330 prevents the boot attachment member 302 from being rotated beyond the second intermediate position without the user again physically and fully retracting the locking member 319.

A left-foot-forward user may transition from a normal riding position to an intermediate riding position by retracting locking member 319 from one of slots 322 and rotating the boot attachment member 302 in a counter-clockwise direction until locking member 319 is moved into one of intermediate positions 394 or 396. The boot attachment member 302 is moveable from either of intermediate positions 394 or 396 to a normal riding position by simply rotating the boot attachment member in a clockwise direction until locking member 319 engages one of slots 322.

A feature of the present invention is that the placement of the double-angled stopping members 324 and 326, the locking plate slots 320 and 322, and the boot attachment member locking device 318 may be altered to accommodate a wide variety of binding configurations. This is evidenced by the comparison of FIGS. 1 and 8.

Figure 9:
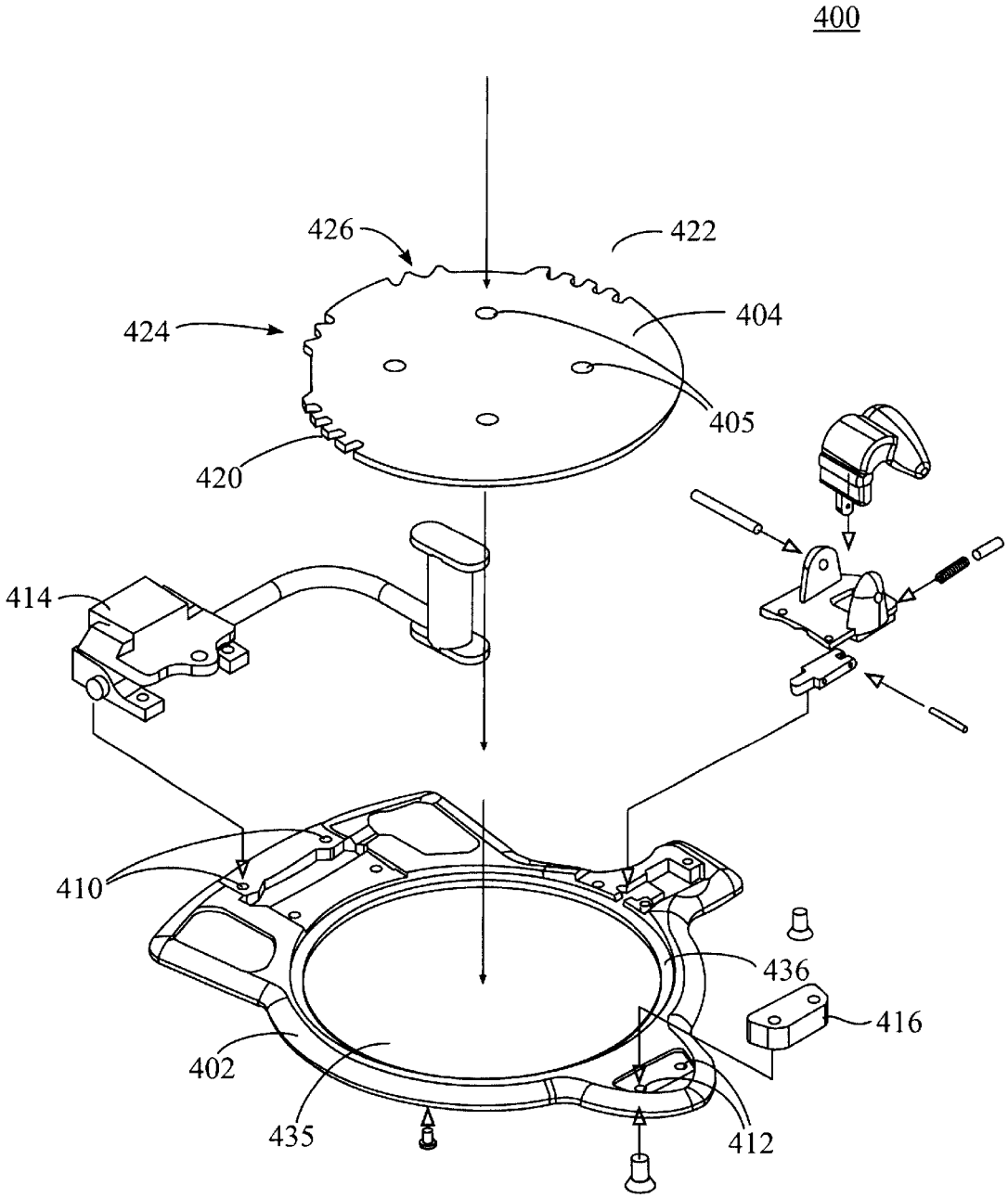
FIG. 9 is an expanded view of a boot binding in accordance with another embodiment of the present invention.

With reference to FIG. 9, boot binding 400 of another embodiment of the present invention is shown. Binding 400 includes a boot attachment member 402 and a locking plate 404. Boot attachment member 402 has holes 410 and 412 to facilitate the attachment of a heel clip 414 and a toe clip 416, respectively. The heel and toe clip arrangement shown represents a step-in type binding. As previously noted, the present invention is not limited to a step-in binding, but is applicable to any of a number of binding types.

Locking plate 404 is supported within an opening 435 in boot attachment member 402. More particularly, locking plate 404 rests upon and is in sliding engagement with a recess/shoulder 436 that encircles opening 435. In FIG. 9 shoulder 436 is shown completely encircling opening 435. In an alternative embodiment, shoulder 436 may not completely encircle opening 435. For example, in order to decrease the contact surface area between locking plate 404 and boot attachment assembly 402, shoulder 436 may be include a series of spaced apart shoulder segments.

Locking plate 404 has a set of bolt holes 405 that are used to secure the locking plate 404 to a snowboard (not shown). A first and second set of spaced apart slots 420 and 422 are symmetrically located along the outer periphery of locking plate 404. A first and second set of double-angled stopping members 424 and 426 are also symmetrically located along the outer periphery of locking plate 404. The double-angled stopping members are preferably located at a midpoint between the first and second set of slots 420 and 422. As discussed above, the symmetric configuration of locking plate 404 permits the boot binding to be rotated to accommodate either a left-foot-forward riding position or a right-foot-forward (goofy foot) riding position. It is important to note that the present invention does not require two sets of slots 420 and 422, nor two sets of double-angled stopping members 424 and 426. In one embodiment, locking plate 404 may only include slots 422. In another embodiment, locking plate 404 may only include slots 422 and a single double-angled stopping member 426*b*. In yet another embodiment, locking plate 404 may include a single slot 422 (versus a plurality of slots) and a single double-angled stopping member 426*b*. In another embodiment, locking plate 404 includes a plurality of spaced-apart slots disposed around, or substantially around, the entire circumference of the locking plate.

Figure 12:
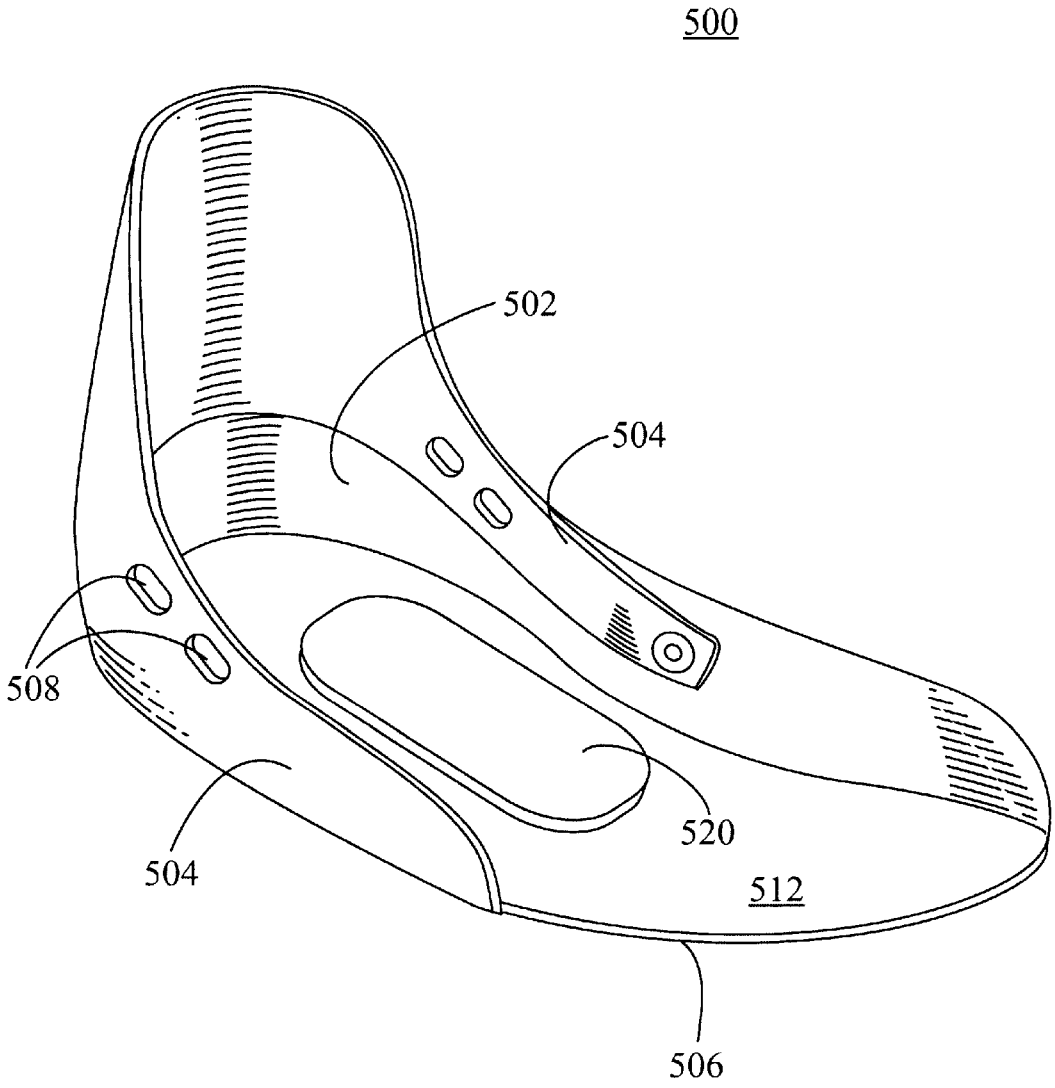
FIG. 12 is a perspective view of a strap-in boot binding having a boot binding shock absorber.

FIG. 12 shows a conventional strap-in boot binding 500. Binding 500 includes a heel wall 502, left and right side walls 504, and a foot binding plate 506. The left and right side walls 504 have a plurality of attachment points, such as holes 508, necessary to attach retainers (not shown), such as cords, laces, straps, or the like, for retaining a boot in the binding 500. Foot binding plate 506 comprises a heel portion 510 and a toe portion 512. A compressible member 520 is located between the heel portion 510 and toe portion 512. In one embodiment, compressible member 520 extends upwardly from plate 506. The shape and height of compressible member 520 is molded, or otherwise formed, to act upon a boot (not shown) situated within binding 500. Preferably, the compressible member 520 exerts a upward force to the boot and retains some compressibility when the weight of the user bears upon the compressible member. The compressible member 520 acts as a shock absorber to the user during downhill maneuvers.

Figure 13:
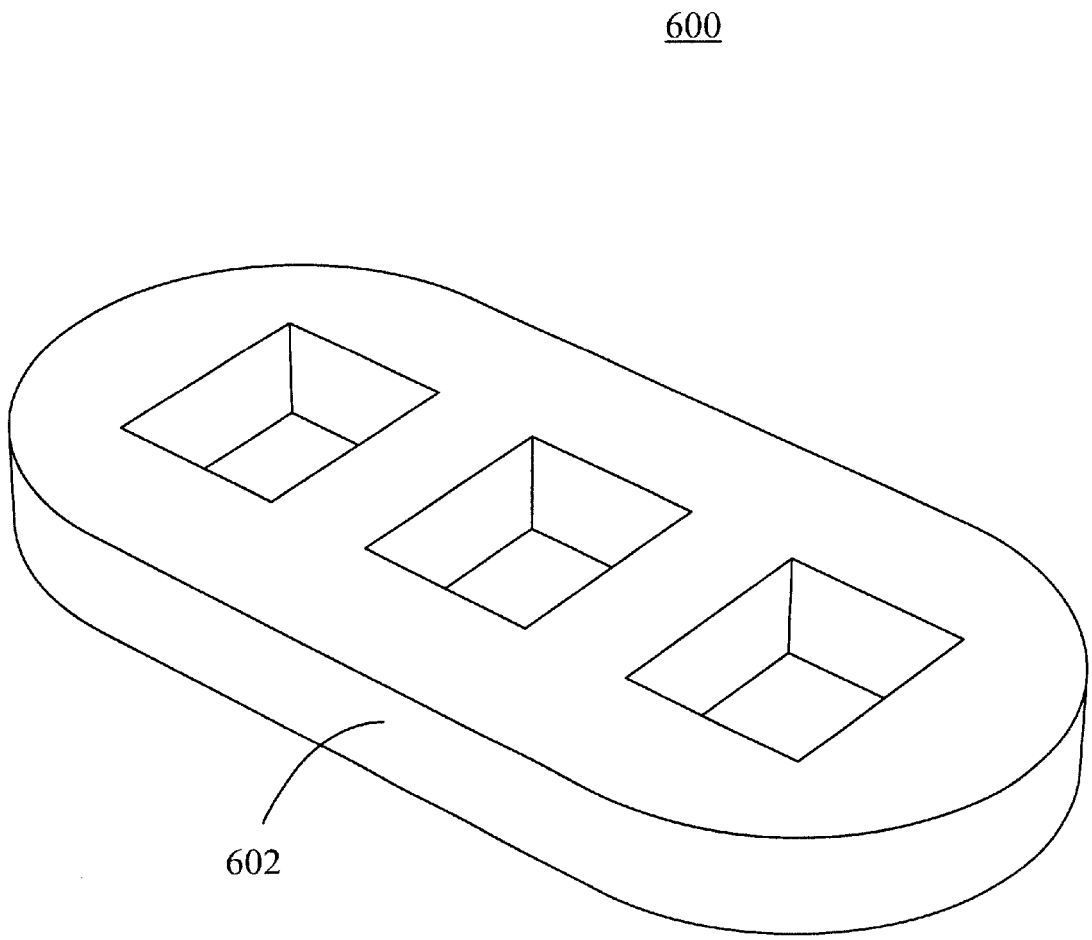
FIG. 13 is a side view of boot shock absorber configured to be attachable or insertable into a strap-in snowboard boot binding.

As shown in FIG. 13, a shock absorber device 600 that is insertable into a conventional strap-in boot binding is shown. The shock absorber device 600 includes a compressible member 602 that is shaped to fit within, or upon, the foot plate of a boot binding. The compressible member may be a foam material, elastomeric material, a gel-filled membrane, an air-filled membrane, a plurality of spring members encased within a substrate, or any other material or structure that is capable of absorbing shock.

Throughout the description the terms "locking plate" and "locking ring" have been used. It is important to note that the terms are interchangeable. That is, the term "locking plate" encompasses a "locking ring". Likewise, the term "locking ring" encompasses a "locking plate".

In the foregoing detailed description, the present invention has been described with reference to specific exemplary embodiments. However, it will be evident that various modifications and changes may be made without departing from the broader scope and spirit of the present invention. The present specification and figures are accordingly to be regarded as illustrative rather than restrictive.

What is claimed is:

1. A snowboard binding comprising:

a boot attachment member having a first opening;

a locking plate supported within said first opening of said boot attachment member, said boot attachment member slideable with respect to said locking plate, said locking plate attachable to a snowboard, said locking plate having a slot and a double-angled stopping member;

a first locking member coupled to said boot attachment member, said first locking member comprising a a releasable tab, said releaseable tab engageable with said slot to lock said boot attachment member in a first radial position, said releaseable tab engageable with said double-angled stopping member to hold said boot attachment member in a second radial position, wherein said releaseable tab is disengageable from said double-angled stopping member by applying only a swivel force to said boot attachment member.

2. The snowboard binding of claim 1 wherein said first locking member is biased in a direction toward said locking plate.

3. The snowboard binding of claim 1 wherein said locking plate has a first slot and a second slot symmetrically located on said locking plate, said first slot defining a first radial position corresponding to a right-foot-forward riding position, said second slot defining a second radial position corresponding to a left-foot-forward riding position, said boot attachment member rotatably slideable between said first and second slots.

4. The snowboard binding of claim 1 further comprising a plurality of pads disposed on a bottom surface of said boot attachment member, said pads contacting the snowboard when said locking plate is attached to the snowboard, said pads having a surface hardness less than the surface hardness of a top surface of the snowboard.

5. The snowboard binding of claim 1 further comprising a flexible cover member disposed over said stationary plate, said cover member having an outward bow.

6. The snowboard binding of claim 1 further comprising a cover member disposed over said stationary plate, said cover member having a compressible member located on an upper surface of the cover member.

7. The snowboard binding of claim 1 further comprising a cover member disposed over said stationary plate, said cover member having an elastomeric material extending upwardly from an upper surface thereof.

8. The snowboard binding of claim 1 wherein said locking plate has a first plurality of slots and a second plurality of slots symmetrically located along the periphery of said locking plate, said first slots defining a first plurality of right-foot-forward radial riding positions, said second plurality of slots defining a second plurality of left-foot-forward radial riding positions, said boot attachment member rotatably slideable between said first and second plurality of slots.

9. The snowboard binding of claim 8 further comprising a cover disposed over said locking plate, said cover having a first protruding member and a second protruding member symmetrically positioned on said cover, said first protruding member insertable into one of said first plurality of slots, said second protruding member insertable into one of said second plurality of slots.

10. A snowboard binding comprising:

a boot attachment member having a first opening;

a locking plate supported within said first opening of said boot attachment member, said boot attachment member slideable with respect to said locking plate, said locking plate having a first slot and a first double-angled stopping member;

a stationary plate for mounting said boot attachment member to a snowboard, said stationary plate engaging said locking plate, said locking plate transversely moveable relative to said stationary plate;

a first locking member coupled to said boot attachment member, said first locking member comprising a releasable tab, said releaseable tab engageable with said first slot to lock said boot attachment member in a first radial position, said releaseable tab engageable with said first double-angled stopping member to hold said boot attachment member in a second radical position, wherein said releaseable tab is disengageable from said first double-angled stopping member by applying only a swivel force to said boot attachment member.

11. The snowboard binding of claim 10 wherein said locking plate has a first transverse member and said stationary plate has a second transverse member that is mateable with said first transverse member, said first transverse member transversely slideable relative to said second transverse member.

12. The snowboard binding of claim 11 wherein said first transverse member comprises a transverse beam and said second transverse member comprises a transverse recess, said beam slideable within said recess.

13. The snowboard binding of claim 10 wherein said locking plate has a second slot, said first and second slots symmetrically located on said locking plate, said first slot defining said first radial position corresponding to a right-foot-forward riding position, said second slot defining a third radial position corresponding to a left-foot-forward riding position, said boot attachment member rotatably slideable between said first and second slots.

14. The snowboard binding of claim 11 wherein at least one of said first and second transverse members has a lubricious coating.

15. The snowboard binding of claim 11 further comprising a second locking member mounted within said stationary plate, said first transverse member having a plurality of spaced apart slots, said second locking member mateable with said slots to lock the transverse position of said locking plate when said locking member is inserted into one of said slots.

16. The snowboard binding of claim 11 further comprising a second locking member mounted within said stationary plate, said locking plate having a plurality of spaced apart slots transversely located along the sidewall of an opening in said locking plate, said second locking member mateable with said slots to lock the transverse position of said locking plate when a plunger is inserted into one of said slots.

17. The snowboard binding of claim 10 further comprising a plurality of pads disposed on a bottom surface of said boot attachment member, said pads contacting the snowboard when said boot attachment member is mounted to the snowboard, said pads having a surface hardness less than the surface hardness of a top surface of the snowboard.

18. The snowboard binding of claim 10 further comprising a flexible cover member disposed over said stationary plate, said cover member having an outward bow.

19. The snowboard binding of claim 10 further comprising a cover member disposed over said stationary plate, said cover member having a deformable and resilient member located on an upper surface of the cover member.

20. The snowboard binding of claim 10 further comprising a cover member disposed over said stationary plate, said cover member having an elastomeric material on an upper surface thereof.

21. The snowboard binding of claim 10 wherein said locking plate has a first plurality of slots and a second plurality of slots symmetrically located along the periphery of said locking plate, said first plurality of slots including said first slot, said first plurality of slots defining a first plurality of right-foot-forward radial riding positions, said second plurality of slots defining a second plurality of left-foot-forward radial riding positions, said boot attachment member rotatably slideable between said first and second plurality of slots.

22. The snowboard binding of claim 21 further comprising a cover disposed over said locking plate, said cover having a first protruding member and a second protruding member symmetrically positioned on said cover, said first protruding member insertable into one of said first plurality of slots, said second protruding member insertable into one of said second plurality of slots.

23. The snowboard binding of claim 10 wherein said locking plate has a second double-angled stopping member, said first and second double-angled stopping members symmetrically located along the periphery of said locking plate, said releaseable tab engageable with either of said first and second double-angled stopping members.

24. A snowboard binding comprising:

a boot attachment member having a first opening;

a locking plate supported within said first opening of said boot attachment member, said locking plate having a first slot and a second slot symmetrically located on said locking plate, said locking plate having a first double-angled stopping member defining a second radial position, said first slot defining a right-foot-forward radial riding position, said second slot defining a left-foot-forward radial riding position, said boot attachment member rotatably slideable between said first and second slots; and stationary plate for mounting said boot attachment member to a snowboard, said stationary plate engaging said locking plate; and a first locking member coupled to said boot attachment member, said first locking member comprising a releaseable tab engageable with one of said first and second slots to lock said boot attachment member in a first radial position;

wherein said releasable tab is engageable with said first double-angled stopping member to hold said boot attachment member in said second radial position, said releaseable tab is disengageable from said first double-angled stopping member by applying only a swivel force to said boot attachment member.

25. The snowboard binding of claim 24 wherein said locking plate is transversely moveable relative to said stationary plate.

26. The snowboard binding of claim 24 wherein said locking plate includes a first transverse member and said stationary plate has a second transverse member that is mateable with said first transverse member, said first transverse member transversely slideable relative to said second transverse member.

27. The snowboard binding of claim 24 wherein said releaseable tab is biased in a direction toward said locking plate.

28. The snowboard binding of claim 26 wherein said first transverse member comprises a transverse beam and said second transverse member comprises a transverse recess, said beam slideable within said recess.

29. The snowboard binding of claim 26 wherein at least one of said first and second transverse members has a lubricious coating.

30. The snowboard binding of claim 26 further comprising a second locking member mounted within said stationary plate, said first transverse member having a plurality of spaced apart slots, said second locking member mateable with said slots to lock the transverse position of said locking plate when said locking member is inserted into one of said slots.

31. The snowboard binding of claim 26 further comprising a second locking member mounted within said stationary plate, said locking plate having a plurality of spaced apart slots transversely located along the sidewall of an opening in said locking plate, said second locking member mateable with said slots to lock the transverse position of said locking plate when said plunger is inserted into one of said slots.

32. The snowboard binding of claim 24 further comprising a plurality of pads disposed on a bottom surface of said boot attachment member, said pads contacting the snowboard when said boot attachment member is mounted to the snowboard, said pads having a surface hardness less than the surface hardness of a top surface of the snowboard.

33. The snowboard binding of claim 24 further comprising a compressible cover member disposed over said stationary plate, said cover member having an outward bow.

34. The snowboard binding of claim 24 further comprising a cover member disposed over said stationary plate, said cover member having a compressible member located on an upper surface of the cover member.

35. The snowboard binding of claim 24 wherein said locking plate has a first plurality of slots and a second plurality of slots symmetrically located along the periphery of said locking plate, said first slots defining a first plurality of right-foot-forward radial riding positions, said second plurality of slots defining a second plurality of left-foot-forward radial riding positions, said boot attachment member rotatably slideable between said first and second plurality of slots.

36. The snowboard binding of claim 35 further comprising a cover disposed over said locking plate, said cover having a first protruding member and a second protruding member symmetrically positioned on said cover, said first protruding member insertable into one of said first plurality of slots, said second protruding member insertable into one of said second plurality of slots.

37. The snowboard binding of claim 24 further comprising a first locking member coupled to said boot attachment member, said locking plate having a second double-angled stopping members, said first and second double-angled stopping members symmetrically located along the periphery of said locking plate, said first locking member engageable with either of said first and second double-angled stopping members.

* * * * *